US011448070B2

(12) United States Patent
Ekefalk et al.

(10) Patent No.: US 11,448,070 B2
(45) Date of Patent: Sep. 20, 2022

(54) ROCK BOLTING RIG AND METHOD AT ROCK BOLTING RIG

(71) Applicant: EPIROC ROCK DRILLS AKTIEBOLAG, Örebro (SE)

(72) Inventors: Martin Ekefalk, Kumla (SE); Jan Olsson, Örebro (SE); Björn Anders Larsson, Södertälje (SE); René Deutsch, Örebro (SE); Hans Gustavsson, Örebro (SE)

(73) Assignee: EPIROC ROCK DRILLS AKTIEBOLAG, Örebro (SE)

( * ) Notice: Subject to any disclaimer, the term of this patent is extended or adjusted under 35 U.S.C. 154(b) by 0 days.

(21) Appl. No.: 17/058,720

(22) PCT Filed: May 27, 2019

(86) PCT No.: PCT/SE2019/050483
§ 371 (c)(1),
(2) Date: Nov. 25, 2020

(87) PCT Pub. No.: WO2019/231383
PCT Pub. Date: Dec. 5, 2019

(65) Prior Publication Data

US 2021/0207479 A1 Jul. 8, 2021

(30) Foreign Application Priority Data

May 28, 2018 (SE) ..... 1850636-0

(51) Int. Cl.
*E21D 20/00* (2006.01)

(52) U.S. Cl.
CPC ..... *E21D 20/006* (2013.01)

(58) Field of Classification Search
CPC ..... E21D 20/006; E21D 20/00; E21D 20/023; E21B 7/025
See application file for complete search history.

(56) References Cited

U.S. PATENT DOCUMENTS 4,226,559 A * 10/1980 Prebensen ..... E21B 7/025 173/184
4,229,124 A * 10/1980 Frey ..... E21D 20/006 405/303

(Continued)

FOREIGN PATENT DOCUMENTS

CA 2298845 A1 8/2000
CA 2899040 A1 7/2014

(Continued)

OTHER PUBLICATIONS

International Search Report and Written Opinion in corresponding International Application No. PCT/SE2019/050483 dated Sep. 16, 2019 (9 pages).

(Continued)

*Primary Examiner* — Benjamin F Fiorello
(74) *Attorney, Agent, or Firm* — Sage Patent Group

(57) ABSTRACT

A rig adapted for rock bolting comprising a feeding magazine is provided. The feeding magazine comprises a holding structure for bolts and is arranged in conjunction with a rock reinforcement unit. The rig further comprises a feeding device that is arranged to provide the rock reinforcement unit with bolts from the feeding magazine. The rig further comprises a loading magazine comprising a holding structure for bolts, as well as a, relative to the feeding magazine and the loading magazine, moveable picking device arranged to move bolts that are located in the loading magazine such that they are accessible to the feeding device.

20 Claims, 17 Drawing Sheets

(56) References Cited

U.S. PATENT DOCUMENTS

| | | | | |
|---|---|---|---|---|
| 4,398,850 | A * | 8/1983 | Talvensaari | E21D 20/006 173/193 |
| 5,114,279 | A * | 5/1992 | Bjerngren | E21D 20/006 405/303 |
| 6,135,674 | A | 10/2000 | Neilson | |
| 6,447,210 | B1 * | 9/2002 | Coombs | E21D 20/025 405/259.5 |
| 6,698,529 | B2 * | 3/2004 | Coombs | E21D 20/006 173/193 |
| 7,654,775 | B2 * | 2/2010 | Ruckman | E02D 3/08 405/259.1 |
| 10,100,592 | B2 * | 10/2018 | Wase | E21B 19/161 |
| 10,557,309 | B2 * | 2/2020 | Morissette | E21B 19/086 |
| 2004/0177979 | A1 | 9/2004 | Rubie et al. | |
| 2004/0178004 | A1 * | 9/2004 | MacDonald | E21B 7/025 175/162 |
| 2007/0286707 | A1 | 12/2007 | Eddowes et al. | |
| 2012/0213598 | A1 | 8/2012 | Lugg et al. | |
| 2015/0218944 | A1 * | 8/2015 | Nystrom | E21D 20/006 700/275 |
| 2016/0115789 | A1 * | 4/2016 | Nystrom | E21D 20/028 221/1 |
| 2017/0159434 | A1 | 6/2017 | Pettersson et al. | |

FOREIGN PATENT DOCUMENTS

| | | | |
|---|---|---|---|
| CA | 2888184 | A1 | 10/2016 |
| CA | 2942462 | A1 | 3/2017 |
| EP | 2803812 | A1 | 11/2014 |
| EP | 3147448 | A1 | 3/2017 |
| EP | 3181803 | A1 | 6/2017 |
| RU | 2014144275 | A | 5/2016 |
| SE | 509937 | C2 | 3/1999 |
| SE | 1450836 | A1 | 1/2016 |
| SE | 539411 | C2 | 9/2017 |
| WO | 9964722 | A1 | 12/1999 |
| WO | 02103162 | A1 | 12/2002 |
| WO | 2014035317 | A1 | 3/2014 |
| WO | 2016001315 | A1 | 1/2016 |

OTHER PUBLICATIONS

Russian Search Report in corresponding Russian Application No. 2020135060 dated Dec. 22, 2021 (4 pages).

* cited by examiner

ROCK BOLTING RIG AND METHOD AT ROCK BOLTING RIG

CROSS-REFERENCE TO RELATED APPLICATIONS

This application is a U.S. National Stage application of PCT/SE2019/050483, filed May 27, 2019 and published on Dec. 5, 2019 as WO 2019/231383, which claims the benefit of Swedish Patent Application No. 1850636-0 filed May 28, 2018, all of which are hereby incorporated by reference in their entireties.

TECHNICAL FIELD

The present invention relates to rock bolting, for example within the mining industry and at tunnel construction. The invention particularly concerns a device and a method at a rock bolting rig.

BACKGROUND

In conjunction with tunneling or in mining the rock is weakened, which may lead to parts of the rock collapsing. There is thus a need for measures which reduces the risk of collapse. Such measures are usually called rock reinforcement. A common method for rock reinforcement is rock bolting. One type of rock bolting comprises a rock reinforcement unit fastening a bolt in the rock. The bolt may e.g. be fastened in pre-drilled hole or may be drilled into the rock during the fastening procedure.

A plurality of rock bolts are usually needed in order to secure the rock. The bolts may e.g. be placed radially in a semi-circular shape along the inside of the cavity which is being bolted, such as e.g. the wall of a tunnel. A magazine arranged in close proximity to the rock reinforcement unit is usually used in order to be able to handle a plurality of rock bolts during a single work shift. The bolts in the magazine are fed one after the other to the rock reinforcement unit and are thereafter bolted into the rock.

CA 2942462 A1 discloses a magazine 106 for drill rods 104 as well as a loading arm 102 for loading drill rods from the magazine to a rock drilling machine. The loading arm can be moved between the magazine, the rock drilling machine and an external source of additional rods.

SE 1450836 A1 describes an arrangement and a method for mounting bolts in the wall of a tunnel. The arrangement comprises a bolting unit comprising a bolt holder. According to one embodiment the arrangement may comprise a storage of bolts in the form of two cases 400, 410 containing bolts of different sizes. The bolt holder may fetch bolts from the storages by the bolting unit being moved from a bolting position to the bolt storages.

At mining generally and rock bolting specifically there is always a risk that the tunnel may collapse as the work is performed. There therefore exist a need for efficient and safe working methods at rock bolting, where personnel residing at the bolting site can be avoided. Thus, in light of the prior art there is today a need to achieve a device at rock bolting which can operate in an efficient and safe manner.

SUMMARY

An object of the present invention is therefore to achieve a device at rock bolting which is efficient and reduces risks for personnel. Alternatively, the object is to achieve an alternative to known solutions within the technical field.

The object is achieved according to a first aspect of the invention by a rig adapted for rock bolting. The rig comprises a feeding magazine, where the feeding magazine comprises a holding structure for bolts and is arranged in conjunction with a rock reinforcement unit, as well as a feeding device which is arranged to provide the rock reinforcement unit with bolts from the feeding magazine. The rig further comprises a loading magazine comprising a holding structure for bolts as well as a relative to the feeding magazine and loading magazine movable picking device arranged to move bolts located in the loading magazine such that they are accessible to the feeding device.

By the rig comprising both a feeding magazine and a loading magazine for bolts, a large number of bolts may be brought to the working site. The rig may therefore operate during a longer time before new bolts need to be fetched and brought to the working site. By the picking device being arranged to move bolts located in the loading magazine such that they are accessible to the feeding magazine there is no need for personnel to reside in close proximity to the rock reinforcement unit. Since the rock reinforcement unit is often located at parts of the rock that have a higher risk of collapsing the risk that an operator is hurt during a potential collapse is reduced. Since the picking device may be moved in relation to both the feeding magazine and the loading magazine there is achieved an efficient and flexible device for movement of bolts located in the loading magazine. The rig may therefore operate during a longer period of time before the operator need to manually intervene, which increases the efficiency. Furthermore, the possibility of operating the rig by remote control as well as automating the rig is increased since a greater part of the operating procedure is mechanized and thereby performed by the rig.

Consequently there is achieved a rock bolting device which reduces the risks for the operator during reloading of bolts.

According to some embodiments the picking device is arranged to move bolts from the loading magazine to the feeding magazine.

By the picking device moving bolts from the loading magazine to the feeding magazine the feeding magazine may be loaded with bolts when it has become empty. By loading the feeding magazine and always pick bolts to the rock reinforcement device, the loading magazine need not be adapted to the feeding device. The loading magazine may thereby be adapted to be able to store a large amount of bolts and the need of the operator's presence may therefore be minimized.

According to some embodiments the holding structures of the loading magazine and the feeding magazine are arranged to hold bolts in predetermined positions, wherein these position together exhibit a bolt position structure within the respective magazine.

Since the holding structures of the loading magazine and the feeding magazine in this way are arranged to hold bolts in predetermined positions, the loading and unloading of the magazines may be simplified, e.g. since the loading and unloading may then easier be mechanized and/or automated. Furthermore, picking devices and extra magazines may then be adapted to the structure, e.g. by exhibiting a similar structure, which provides a more efficient operation.

According to some embodiments the bolt position structure of the loading magazine substantially corresponds to the bolt position structure of the feeding magazine.

Since the loading magazine and the feeding magazine in such a way are arranged to exhibit substantially corresponding bolt position structures the moving of bolts between the magazines may be facilitated, the bolts may e.g. be fetched from the loading magazine through a movement of the picking device which correspond to the movement which is performed when they are placed in the feeding device.

According to some embodiments the picking device comprise a transportation unit arranged to be moved between the loading magazine and the feeding magazine, as well as a to the transportation unit moveably arranged picking unit arranged to be moved relative to the transportation unit between a transportation position outside the magazines and a picking position inside the respective magazine. The picking unit may further be arranged to pick a bolt or drop a bolt when it is positioned in the picking position.

By arranging the picking device with a picking unit arranged to a transportation unit a simple and robust device for picking bolts is achieved.

According to some embodiments the picking unit is arranged to grip bolts in predetermined position, wherein the positions together exhibit a bolt position structure within the picking unit. The bolt position structure of the picking unit may substantially correspond to the bolt position structure of the respective magazine.

Through such an arrangement of the picking unit it may fetch a plurality of bolts at the same time, which speeds up the process and thereby increases the efficiency of the rig. Furthermore, the fetching of bolts out of the magazines and the placement of bolts into the magazines may be simplified and sped up by the bolt position structure of the picking unit being adapted to that of the magazines. The bolt position structure of the picking unit may e.g. be variable such that it may be adapted to magazines having different bolt position structures.

Furthermore, by arranged the picking unit with a bolt position structure which substantially correspond to one or both of the magazine's bolt position structures a picking unit which in an efficient manner can fetch and/or drop bolts in the magazines is achieved. The process is in thereby simplified and sped up.

The picking device may be provided with at least one sensor for determining the position of the transportation unit and the picking unit relative to the magazines.

Through such a sensor, the position of the transportation unit and the picking unit relative to the magazine may be determined and may thereby in an easy and safe manner be controlled correctly in order to pick up and drop of bolts. The picking device may e.g. be provided with two sensors, one for the position of the transportation unit and one for the position of the picking unit. In such a way an improved precision when determining the position of the components of the picking device is achieved.

The transportation unit may be arranged to be moved between the loading magazine and the feeding magazine through a first linear movement between the magazines. The picking unit may then be arranged to be moved between the transportation position and the picking position through a second linear movement directed at an angle relative to the first linear movement.

By arranging the transportation unit and the picking unit to be moved with a respective linear movement a picking unit is achieved which may move bolts in the loading magazine in an easy and secure manner. In addition, a compact unit is achieved which is adapted for movement in narrow spaces such as tunnels.

The picking unit may have an elongated shape and comprise two disc-shaped elements arranged at a distance from each other in the longitudinal extension of the picking unit. The disc-shaped elements may comprise a plurality of recesses adapted to receive bolts. The picking unit may furthermore comprise a gripping unit adapted to secure bolts in said recesses during movement between the loading magazine and the feeding magazine.

By arranging the picking unit with two disc-shaped elements and potentially a gripping unit, a simple picking unit having few components that risk breaking is achieved. In addition, a stable support for the bolts as well as a light construction is achieved, since only two discs are required to receive the bolts. Since the picking unit thereby can be arranged with few and simple parts, it may also easily be adapted for different applications, e.g. the usage of bolts having different sizes and/or having different resting positions in the magazines. The picking unit may in addition be produced in a simple manner. Thereby a robust picking unit which can easily be adapted and mass produced is achieved.

The recesses of the disc-shaped elements may be arranged on the disc-shaped elements such that the recesses together exhibit a bolt position structure which substantially corresponds to the respective magazines bolt position structure.

By arranging the recesses of the disc-shaped elements such that they substantially correspond to the respective magazines bolt position structure a picking unit is achieved which using a simple movement can both pick up bolts and drop bolts in the magazines in an efficient manner. The picking unit may furthermore pick a plurality of bolts at the same time. The picking is thus facilitated and adapted to the magazines which result in an increased efficiency.

The gripping unit may be arranged between the disc-shaped elements and may be moved between an open position and a closed position through a displacement of the gripping unit in a direction directed at an angle to the longitudinal extension of the picking unit. The gripping unit may furthermore be arranged to secure a bolt which is received in and extends between a recess in the first disc-shaped element and a recess in the second disc-shaped element when the gripping unit is located in the closed position.

By arranging the gripping unit between the disc-shaped elements there is achieved a symmetrical and stable force distribution on the picking unit during picking of bolts. By securing the bolts through a displacement of the gripping unit in a direction directed at an angle to the longitudinal extension of the picking unit an easy way of securing the bolts in the picking unit is achieved. The displacement may e.g. be parallel to the transversal extension of the picking unit. In such a way a secure locking of the bolts is achieved.

The picking device may be arranged to be moved between a working position where the picking device may move bolts located in the loading magazine, and a resting position adapted for bolting or movement of the rig.

By being able to move the picking device between a working position and a resting position the picking device may be placed in the resting position when moving the rig or when performing bolting. The resting position may be positioned in such a manner that the operator located in the cabin of the rig has a maximal visibility. Thereby a safer and more efficient operation of the rig is achieved.

According to some embodiments the loading magazine may be moved between a reloading position for reloading of bolts from an external source, and a loading position for said movement of bolts which are located in the loading magazine.

Since the loading magazine can move to a reloading position, extra bolts may in an easy and smooth manner be loaded into the loading magazine when needed. The reloading position may e.g. be arranged closer to the ground than the loading position. In such a manner a reloading position is achieved which is easy to reach for an operator.

The picking device may be arranged to move two or more bolts simultaneously.

By arranging the picking device such that it may move two or more bolts simultaneously it is achieved that more bolts can be moved per unit of time. Thereby a more efficient loading of the loading magazine is achieved, and thereby a more efficient rock bolting process.

The picking device may be arranged to move a holding structure containing at least one bolt from the loading magazine to the feeding magazine.

Thereby the rock reinforcement unit may be fed with bolts directly from the holding structure which has been moved from the loading magazine. Access to the bolts in the loading magazine is thereby facilitated. A simpler and more efficient device is thereby achieved. The picking device may be arranged to move a holding structure containing a plurality of bolts from the loading magazine to the feeding magazine.

The holding structure in the feeding magazine may be arranged to be able to be removed from the feeding magazine. The picking arrangement may be arranged to remove the feeding magazine's holding structure from the feeding magazine.

Thereby there may be made room for holding structures which are moved from the loading magazine. An efficient way of providing more bolts when the bolts in the feeding magazine have run out is thus achieved, which leads to a more efficient bolting process.

The above mentioned object is also achieved according to a second aspect of the invention by a method at a rig for moving bolts where the rig is adapted for rock bolting and comprises a feeding magazine comprising a holding structure for bolts which is arranged in conjunction with a rock reinforcement unit. The rig furthermore comprises a feeding device which provides the rock reinforcement unit with bolts from the feeding magazine. The rig furthermore comprises a loading magazine comprising a holding structure for bolts as well as a relative to the loading magazine and feeding magazine moveable picking device. The method comprises to, using the picking device, move bolts located in the loading magazine such that they are accessible to the feeding device.

By utilizing this method the rig may operate for a long time before new bolts need to be collected and brought to the operating site. By the picking device moving bolts which are located in the loading magazine such that they are accessible to the feeding magazine no personnel need to reside in close proximity to the rock reinforcement unit. Since the rock reinforcement unit is often located at parts of the rock with a higher risk of collapsing the risk that personnel is hurt during a potential collapse is thus reduced. Since the picking device is arranged to be moved in relation to both the feeding magazine and the loading magazine an efficient and flexible method for movement of bolts located in the loading magazine is enabled. The rig may therefore operate during a longer period of time before the operator need to manually intervene, which increases the efficiency. Furthermore, the possibility of operating the rig by remote control as well as automating the rig is increased since a greater part of the operating procedure is mechanized and thereby performed by the rig.

By performing the method in the above mentioned way an efficient rock bolting method which reduces the risk for the operator is thus achieved.

According to some embodiment the method further comprises to, using the picking device, move a holding structure containing at least one bolt from the loading magazine to the feeding magazine.

In such a way the rock reinforcement unit may be fed with bolts directly from the holding structure which has been moved from the loading magazine. In such a way the access to the bolts in the loading magazine is simplified. Thereby a simpler and more efficient device is achieved.

According to some embodiments the holding structure in the feeding magazine is arranged to be able to be removed from the feeding device, wherein the method furthermore comprises to remove the holding structure from the feeding magazine. The method may according to some embodiments comprise to remove the holding structure from its position using the picking device.

In such a way there may be made room for holding structures which are moved from the loading magazine. Thereby an efficient way of providing more bolts when the bolts in the feeding magazine have run out is achieved, which leads to a more efficient bolting process.

According to some embodiments the method further comprises to, using the picking device, move bolts from the loading magazine to the feeding magazine.

Since the picking device moves bolts from the loading magazine to the feeding magazine the feeding magazine may be loaded with bolts when it is empty. By loading the feeding magazine and always picking bolts from it to the rock reinforcement unit there is no need to adapt the loading magazine to the feeding device. Thereby the loading magazine may be adapted to store a large amount of bolts.

BRIEF DESCRIPTION OF THE DRAWINGS

Additional objects and advantages to, as well as features of, the invention will be apparent from the following detailed description of one or several embodiments provided with reference to the accompanying drawings, in which.

DETAILED DESCRIPTION

The invention herein will now be described in more detail below with reference to the accompanying drawings, in which example embodiments are shown. The invention should not be construed as limited by the disclosed examples of embodiments, instead it is defined by the appended claims. Like numbers in the figures refer to like elements throughout.

Figure 1:
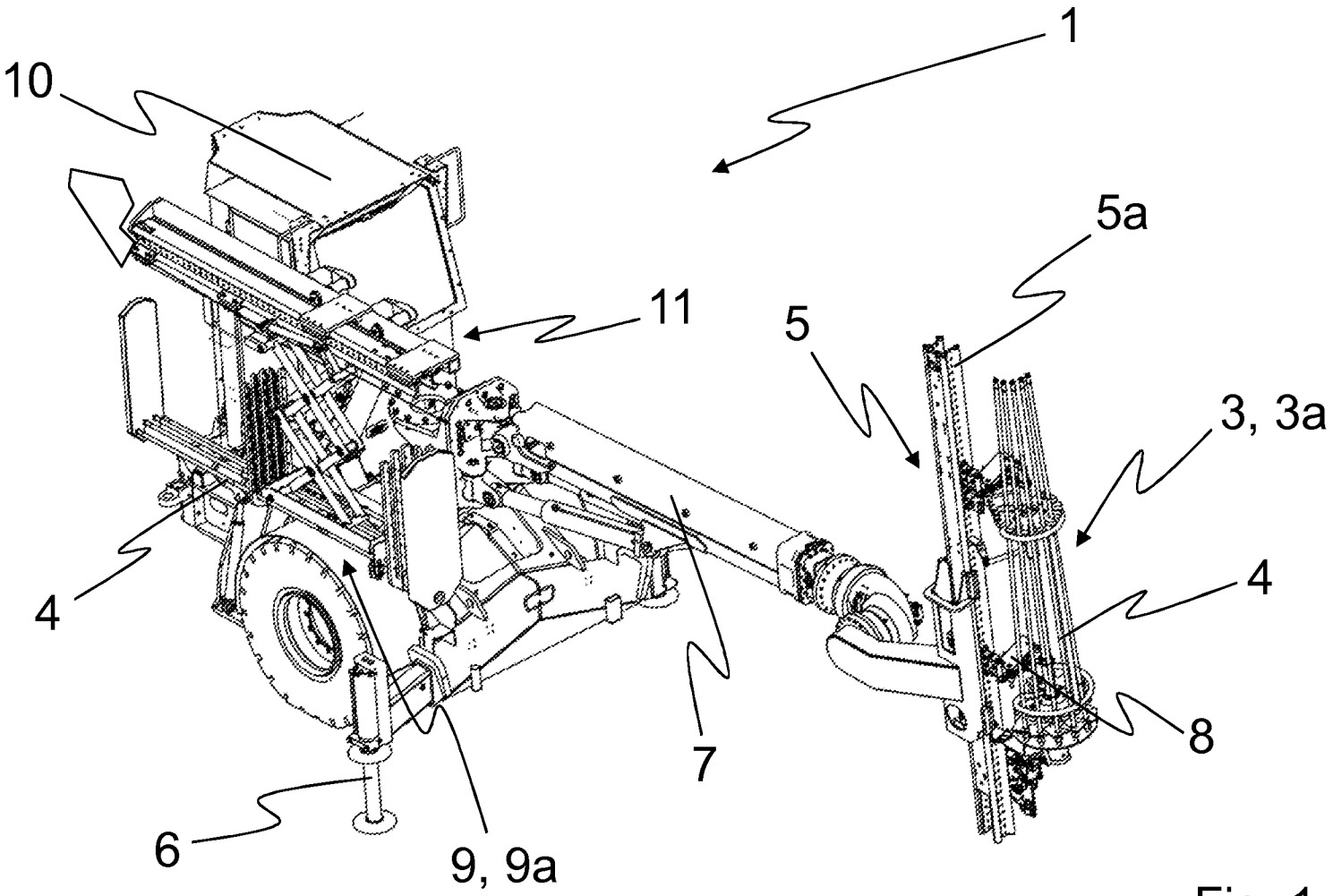
FIG. 1 shows a rig in a perspective view.

FIG. 1 illustrates a rig 1 adapted for rock bolting. The rig comprises a feeding magazine 3 comprising a holding structure 3*a* for bolts 4. The feeding magazine 3 with the holding structure 3*a* is in FIG. 1 exemplified by a revolving magazine, but other types of holding structures 3*a* are contemplated, for example linear holding structures 3*a* supporting a linear bolt position structure (bolt position structure will be explained in greater detail below). The holding structure 3*a* may according to some examples be composed of the feeding magazine 3. According to other examples the feeding magazine 3 may comprise additional elements such as e.g. several holding structures, one or more gripping devices which secures the holding structure 3*a* on the rig 1 etc.

The rig 1 further comprises a rock reinforcement unit 5. With rock reinforcement unit 5 is herein meant a unit arranged to reinforce the rock by fastening rock bolts in the rock. The rock reinforcement unit 5 may comprise a device adapted to bring bolts into the rock, e.g. a bolting tool. The rock reinforcement unit 5 may further comprise a drilling unit for drilling of rock holes before bolting. In an example showing a practical application which is illustrated in FIG. 1 the rock reinforcement unit 5 comprises a feeding rod 5*a*, a drilling tool (not shown in the figure) which may be connected to the feeding rod 5*a* as well as a bolting tool (not shown in the figure) which may also be connected to the feeding rod 5*a*. These two tools may be alternatingly connected to the feeding rod 5*a* in a manner known within the technical field. Another alternative is to use two feeding rods, one with a drilling tool arranged and one with a bolting tool arranged. In that case the feeding rods are instead alternatingly moved to the working position.

The feeding magazine 3 is arranged in conjunction to the rock reinforcement unit 5. The feeding magazine 3 may for example be arranged separately from but in close proximity to the rock reinforcement unit 5, or the feeding magazine 3 may be arranged on the rock reinforcement unit 5. The feeding magazine 3 may e.g. be arranged on the feeding rod 5*a*. The rock reinforcement unit 5 and the feeding magazine 3 may both be arranged on a front part of the rig 1, e.g. on a boom 7 which is arranged on a front part of the rig 1.

The rig 1 further comprises a feeding device 8 which is arranged to provide the rock reinforcement unit 5 with bolts 4 from the feeding magazine 3. The feeding device 8 may for example as is illustrated in FIG. 1 consist of one or several picking arms which may pick bolts 4 from the feeding magazine 3 and move those to the rock reinforcement unit 5. The feeding device 8 may alternatively form a mechanism which can move the entire feeding magazine 3 or a holding structure 3*a* within the feeding magazine 3 towards the rock reinforcement unit 5. A bolt 4 which rests in the feeding magazine 3 will then be moved to the rock reinforcement unit 5 and may thereafter be bolted into the rock. The feeding device 8 may according to another example rotate the feeding magazine 3 or the holding structure 3*a* in the feeding magazine 3 such that a bolt 4 which is located in the feeding magazine 3 is placed in the rock reinforcement unit 5, where after the bolt 4 may be bolted into the rock.

As is shown in FIG. 1 the rig 1 further comprises a loading magazine 9 comprising a holding structure 9*a* for bolts 4. The holding structure 9*a* may according to some examples be composed of the loading magazine 9. According to other examples the loading magazine 9 comprises additional elements such as e.g. additional holding structures, one or more gripping devices which secures the holding structure 9*a* on the rig 1 etc. The loading arrangement 9 is in FIG. 1 arranged in close proximity to an operator cabin 10 on the rig 1. This is advantageous since during operation the rig 1 is usually located in tunnels which risk collapsing. The operator cabin 10 is often located under parts of the rock that are secured and thereby relatively less likely to collapse, than the front part of the rig 1, which is positioned for rock reinforcement operation where the rock per definition is in need of being secured (an unsecured part of the rock). The rig 1 usually rests on support legs 6 during bolting operation. The part of the rig 1 that is located in front of the support legs 6 is then usually located under rock that has not been secured, while the part of the rig 1 which is located behind the support legs 6 is located under rock that has been secured. According to one example the loading magazine 9 may then be arranged behind the support leg 6, i.e. under rock that has been secured. The loading magazine 9 is according to another example located further forward on the rig 1, in front of the support legs 6 and closer to the feeding magazine 3. Other positions are also contemplated. The loading magazine 9 may comprise one or more holding structures 9*a* for bolts 4 and each holding structure 9*a* may contain a plurality of bolts 4, e.g. 40 units.

The rig 1 furthermore comprises a relative to the feeding magazine 3 and the loading magazine 9 moveable or displaceable picking device 11 arranged to move bolts 4 which are located in the loading magazine 9 such that they are accessible to the feeding device 8. With moveable arranged is meant that the picking device 11 or parts of the picking device 11 may be moved or move relative to the magazines 3, 9. The picking device 11 may e.g. be fixedly mounted to the rig 1 but at the same time capable of being rotated, folded or stretched out relative to the rig 1 and the magazines 3, 9. The picking device 11 may alternatively be moved on the rig 1, e.g. on a rail or similar. Another contemplated alternative is that the picking device 11 comprises parts which can be moved relatively to the magazines 3, 9. Different ways of how this may be achieved is exemplified below.

Thereby the rig 1 may bolt a large number of bolts 4 into the rock before it needs to be supplied with new bolts 4. The magazine 9 may for example be dimensioned such that the number of bolts 4 is sufficient to secure the rock after blasting has been performed in the rock. According to an example which is illustrated in FIG. 1 the picking device 11 is arranged in close proximity to the loading magazine 9. The picking device 11 may be arranged to move several bolts 4 simultaneously, e.g. two or four units. This will be described further later.

Figure 2:
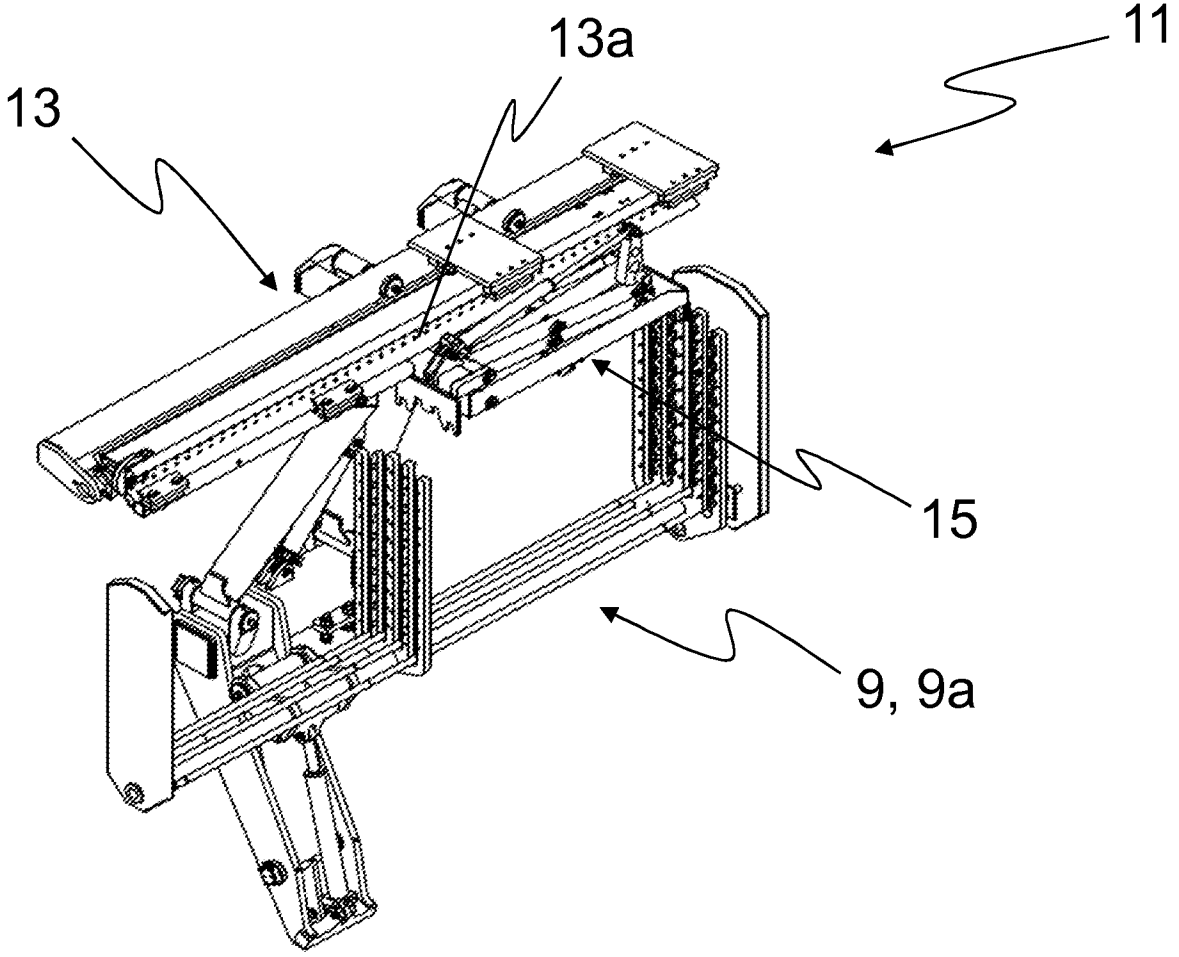
FIG. 2 shows a picking device and a loading magazine in a perspective view.
Figure 3:
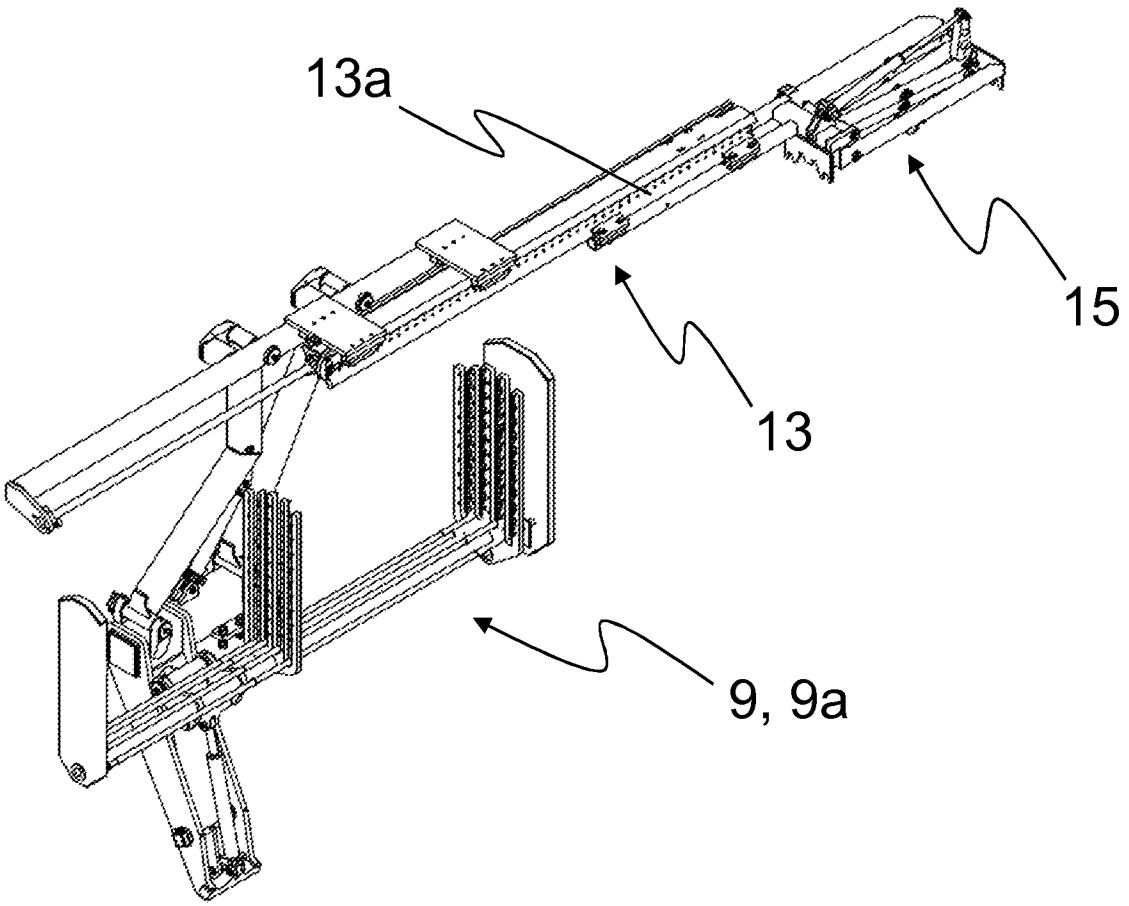
FIG. 3 shows a picking device in an extended position as well as a loading magazine in a perspective view.

FIGS. 2 and 3 illustrate an example of the picking device 11 for picking up and dropping of bolts 4 in the magazines 3, 9. According to this example the picking device 11 may comprise a transportation unit 13. The transportation unit 13 is arranged to be moved between the loading magazine 9 and the feeding magazine 3. This may e.g. be performed by a first linear displacement between the magazines 3, 9. The linear displacement may e.g. be achieved by the transportation unit 13 being able to be moved along or via a sliding beam 13*a*. The sliding beam 13*a* may alternatively be a part of the transportation unit 13 or vice versa. The sliding beam 13*a* may as is illustrated in FIG. 3 be telescopically arranged. By being telescopically arranged the sliding beam 13*a* may extend from a minimal length to a maximal length. In FIG. 2 the sliding beam 13*a* is shown in its minimal extension and in FIG. 3 the sliding beam 13*a* is shown in its maximal extension. The transportation unit 13 is according to this example attached to or a part of the sliding beam 13*a* and the sliding beam 13*a* is arranged such that when it is minimally extended the transportation unit 13 is located above the loading magazine 9 and when the sliding beam 13*a* is maximally extended the transportation unit 13 is located above the feeding magazine 3. The transportation unit 13 may thereby adopt desired position by the sliding beam 13*a* extending between two end positions which correspond to positions above the loading magazine 9 and the feeding magazine 3 respectively. These positions are illustrated in FIGS. 2 and 3 respectively (the feeding magazine 3 is not shown in the figures). Other contemplated solutions are possible, the picking device 11 could e.g. be arranged on a parallel linkage. The parallel linkage could in turn be arranged in front of the loading magazine 9. The picking device 11 would then move in an arc during displacement between the loading magazine 9 and the feeding magazine 3. Other possibilities are pendulum arms or robotic arms arranged with the number of degrees of freedom which are required in order to be able to be moved between the above mentioned positions. According to another example the picking device 11 may move in and out of the magazines 3, 9 or holding structures 3*a*, 9*a* by a movement which is parallel to the plane of the rig 1. In such a way the picking device 11 moves into the holding structures 3*a*, 9*a* from the side. This example may e.g. be useful for remote controlled rigs 1. These do not need an operator cabin 10 and the loading magazine 9 may then be arranged at an angle to the longitudinal extension of the rig 1. The picking device 11 could then be arranged between the magazines 3, 9. The picking device 11 can according to some examples be arranged to move two or more bolts 4 simultaneously.

Figure 4:
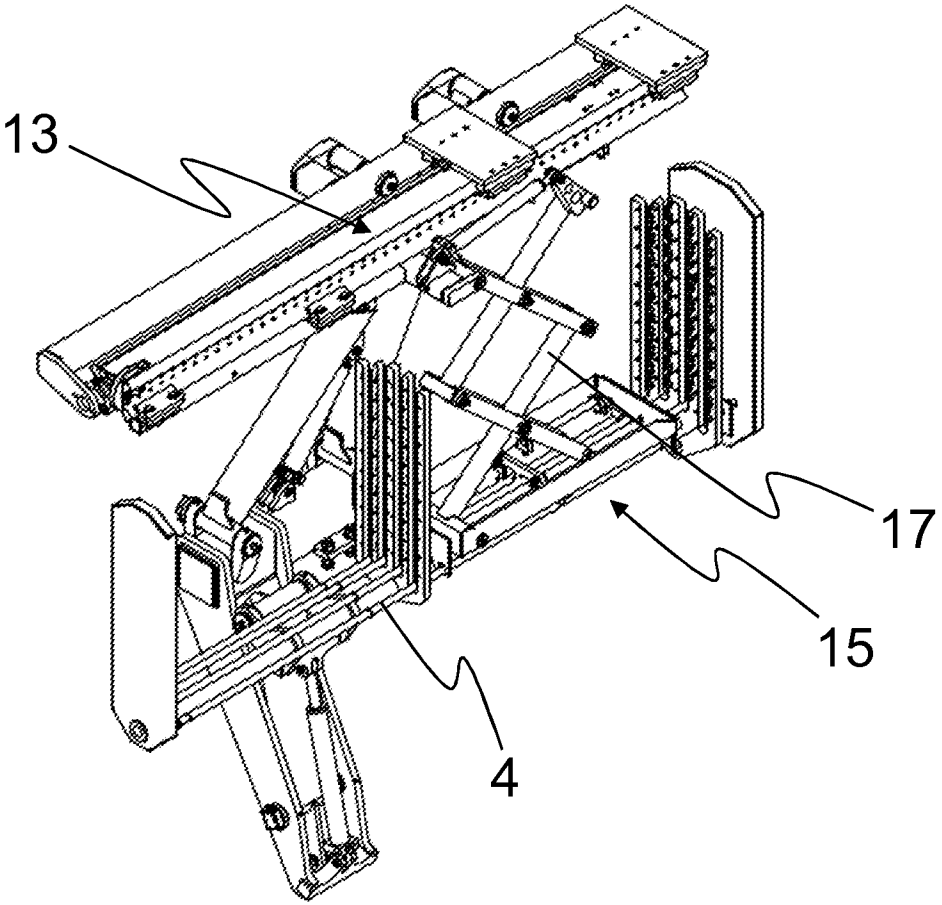
FIG. 4 shows a perspective view of a picking device as it is collecting a bolt in the loading magazine.

The picking device 11 may further comprise a picking unit 15 which is moveably arranged to the transportation unit 13 in order to be displaced relative to the transportation unit 13 between a transportation position outside of the magazines 3, 9 and a picking position inside the respective magazines 3, 9 for picking up or dropping of bolts in the holding structures 3*a*, 9*a*. These positions are thus defined relative to the transportation unit 13 and the magazines 3, 9. The picking unit 15 may thus be located in different positions relative to other elements on the rig 1 while still being located in the transportation position. In FIG. 2 the picking unit 15 is e.g. located in the transportation position outside the loading magazine 9 and in FIG. 3 the picking unit 15 is still located in the transportation position, but now outside the feeding magazine 3 (the feeding magazine 3 is not shown in the figure). When the picking unit 15 is in the picking position it may be located at different position in the magazines 3, 9. As long as the picking unit 15 is capable of picking up or dropping of a bolt in the magazines 3, 9 as well as is located inside either of the magazines 3, 9 the picking unit 15 is thus positioned in the picking position. The picking unit 15 may be arranged to be displaced between the transportation position and the picking position through a second linear movement which is directed at an angle to the transportation unit's 13 linear movement between the magazines 3, 9. The angle may e.g. be 30, 45 or 90 degrees. In FIG. 4 an example of a picking unit 15 is shown where it has been moved perpendicular relative to the direction of movement of the transportation unit 13 into the loading magazine 9 to the picking position. According to this example this movement is achieved by the picking unit 15 being arranged to the transportation unit 13 through a scissor lift 17 and can thereby be moved relative to the transportation unit 13. Other solutions are possible, the picking unit 15 may e.g. be arranged on a knuckle boom or on an arm that can move the picking unit 15 down and up from the magazines 3, 9 through a rotational movement. Other possibilities are to utilize linear actuators or cylinders in ways well known to the skilled person in order to achieve the displacement. The picking unit 15 is also contemplated to be arranged stationary on the transportation unit 13 wherein the magazine 9 or the holding structure 9*a* is instead lifted upwards by a scissor lift such that the picking unit 15 ends up in the picking position. The picking unit 15 then only needs to be arranged to be able to grip the bolts 4, for example as is described below.

Figure 5:
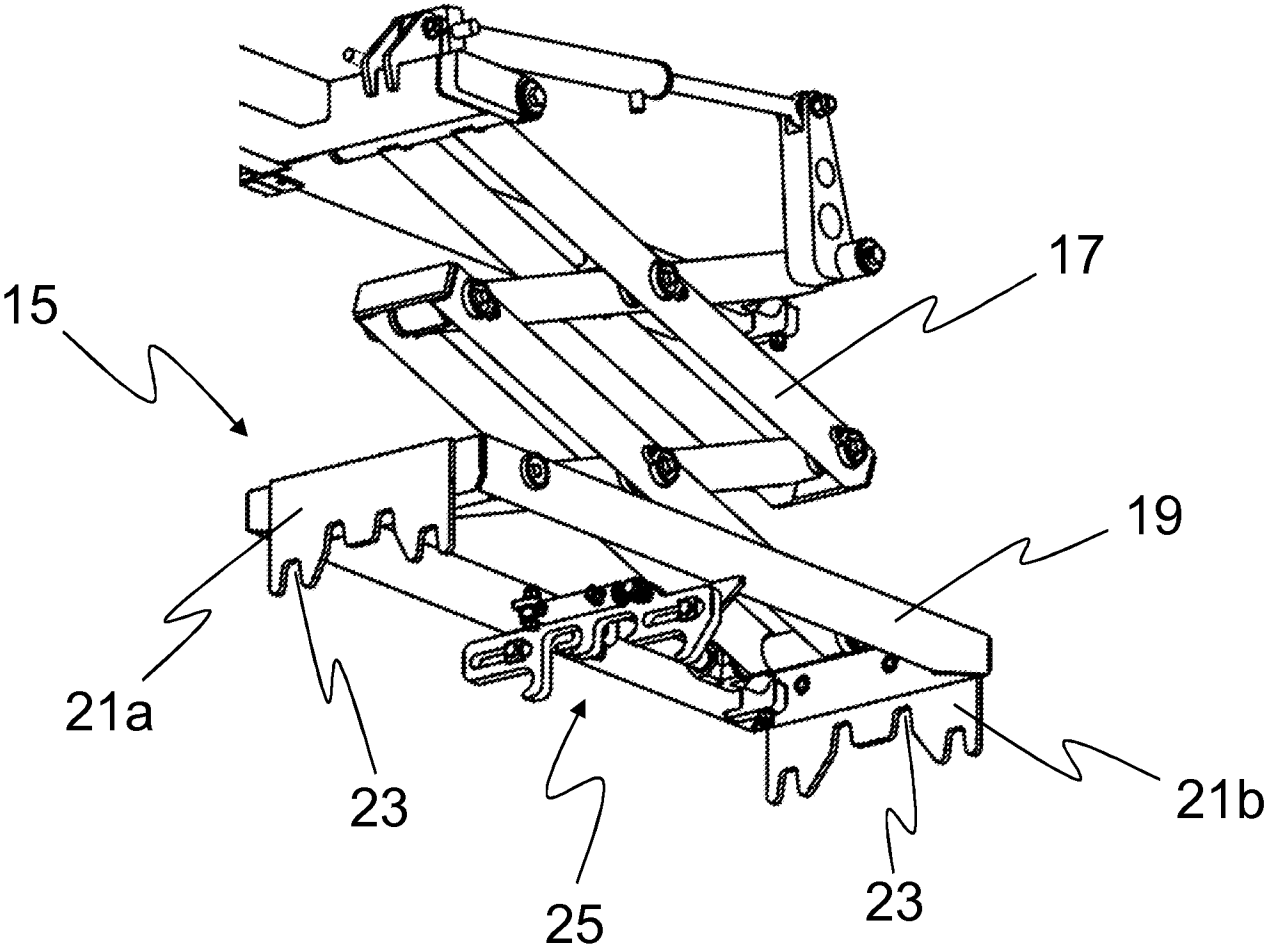
FIG. 5 shows a picking unit of the picking device in a perspective view.

The picking unit 15 is further arranged to pick or leave one or more bolts 4 when it is located in the picking position. This may be achieved in different ways. One example of how the picking unit 15 may be arranged to achieve this is illustrated in conjunction with FIGS. 5 and 6. As can be seen in FIG. 5 the picking unit 15 is arranged on an elongated frame 19. The frame 19 may e.g. be arranged on the scissor lift 17 which has been described above. Disc-shaped elements 21*a*, 21*b* are arranged on the short sides of the frame 19. The disc-shaped elements 21*a*, 21*b* comprise several recesses 23 which are arranged to receive bolts. The recesses 23 in the respective disc-shaped elements 21*a*, 21*b* may be arranged such that the positions of the recesses 23 on the first disc-shaped element 21*a* relative to the frame 19 correspond to the positions of the recesses 23 on the second disc-shaped element 21*b* relative to the frame 19. The bolts 4 which are received in the recesses 23 of the disc-shaped elements 21*a*, 21*b* will then extend between a recess 23 in the first disc-shaped element 21*a* and a recess 23 in the second disc-shaped element 21*b*. The disc-shaped elements 21*a*, 21*b* may have several recesses 23. Thereby several bolts 4 may be picked simultaneously.

The picking unit 15 may further comprise a gripping unit 25 which is arranged to secure bolts in the recesses 23. This may be achieved by the gripping unit 25 being arranged between the disc-shaped elements 21*a*, 21*b* and by being movable between an open position and a closed position through a displacement F of the gripping unit 25 in a direction directed at an angle to the longitudinal extension of the picking unit 15. Examples of the angle may e.g. be 30, 45 or 90 degrees. In the example shown in FIG. 6 the gripping unit 25 is displaced in a direction which is parallel with the extending surface of the frame 19, but perpendicular to the longitudinal extension of the frame 19, i.e. in the transversal extension of the frame 19. The gripping unit 25 is furthermore arranged with gripping elements 27 that will secure one or more bolts 4 that are received in the recesses 23 of the disc-shaped elements 21*a*, 21*b* when the gripping unit 25 is displaced. By displacing the gripping unit 25 in a first direction to a locking position, one or more bolts 4 received in the recesses 23 of the disc-shaped elements 21*a*, 21*b* are secured in these recesses 23. By displacing the gripping unit 25 in a second direction, substantially opposite the first direction, to an open position, the bolts 4 which are received in the recesses 23 of the disc-shaped elements 21*a*, 21*b* are released. The gripping elements 27 may e.g. be arranged such that when the gripping unit 25 is displaced to the locking position the gripping elements 27 will extend at least partly around the periphery of the respective bolt 4 such that the respective bolt 4 is secured in the recess of the disc-shaped elements 21*a*, 21*b* in which it is received. The gripping elements 27 may e.g. be hook-shaped. According to one example the gripping unit 25 is displaced until the bolts are bent somewhat. The operator will then know that they are in a gripped position.

Alternative ways of gripping the bolts 4 are also contemplated. The gripping unit 25 could for example operate using magnetic or electromagnetic locking or other mechanical ways of locking such as rubber bushings, friction rolls, over center locking etc.

The picking device 11 may according to one example be provided with at least one sensor for determining the position of the transportation unit 13 and the position of the picking unit 15 relative to the magazines 3, 9 and/or the holding structures 3*a*, 9*a*. The sensor or sensors may provide the position of the picking device 11 to a control unit or an operator. In the cases where the picking device 11 is arranged with a transportation unit 13 and a picking unit 15 two sensors may be utilized, one for each of the respective component 13, 15. In that way the position of the transportation unit 13 and the picking unit 15 may be determined with god precision. A bobbin actuator may e.g. be used.

Figure 7:
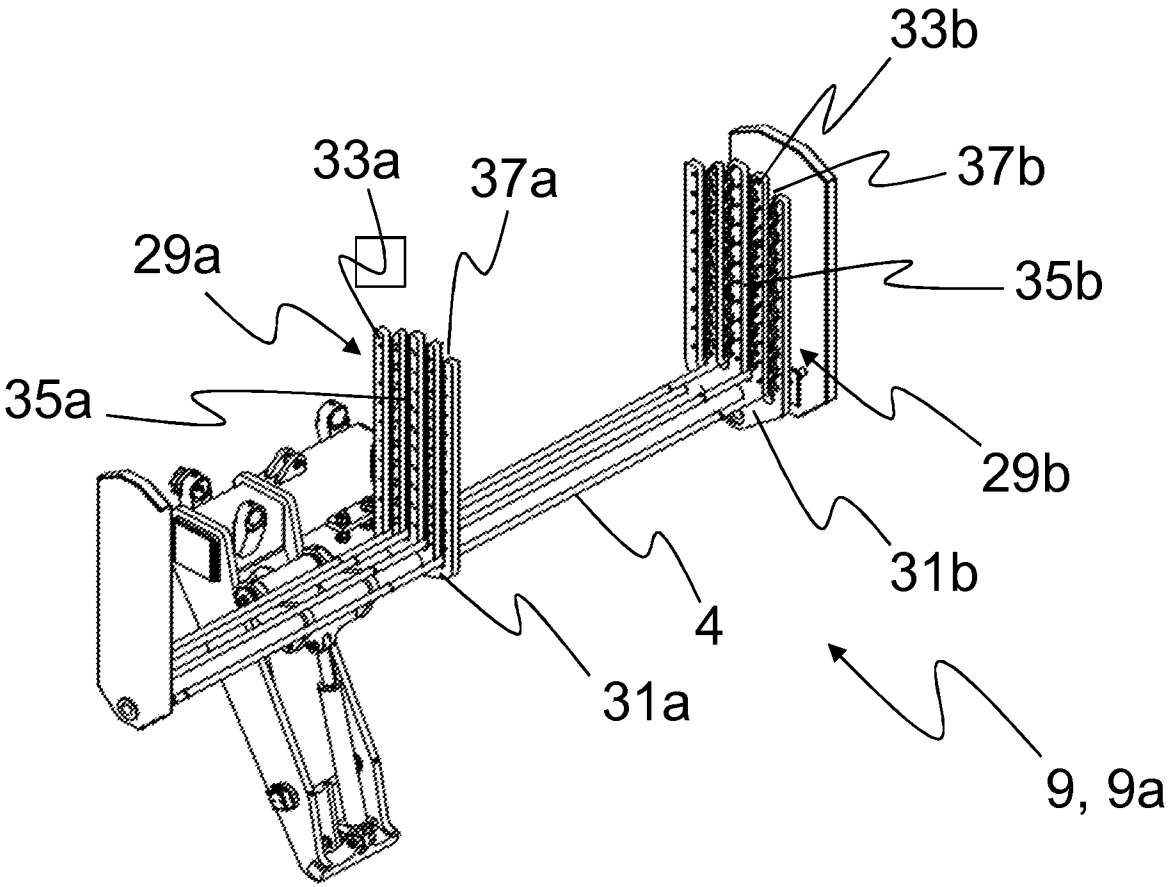
FIG. 7 shows the loading magazine in a perspective view.

As has been mentioned above, the holding structures 3*a*, 9*a* in the feeding magazine 3 and the loading magazine 9 respectively, may be arranged to hold bolts 4 in predetermined position such that these positions together exhibit a certain bolt position structure. With bolt position structure is meant that the bolts 4 will rest in the magazines 3, 9 according to a certain structure, e.g. as seen from a certain angle. One example of such a bolt position structure is apparent from the loading magazine 9 as it is illustrated in FIG. 7. According to the example which is shown in FIG. 7 the holding structure 9*a* is composed of the loading magazine 9. When describing the example below only the holding structure 9*a* will thus be referenced. According to the example in FIG. 7 the holding structure 9*a* comprise two fork-shaped holders 29*a*, 29*b*. The two holders 29*a*, 29*b* exhibit five elements 33*a*, 33*b* or fingers 33*a*, 33*b* extending from the base 31*a*, 31*b* of the holders. These extending elements 33*a*, 33*b* extend straight up from the base 31*a*, 31*b* and together comprise the main surface of the respective holder 29*a*, 39*b*. The five extending elements 33*a*, 33*b* thus delimit four compartments 35*a*, 35*b* or slots 35*a*, 35*b* in each holder 29*a*, 29*b*. The number of extending elements 33*a*, 33*b* and thereby the number of compartments 35*a*, 35*b* may be fewer or more than five and four respectively. Bolts 4 may be placed in layers on top of each other in the compartments 35*a*, 35*b*. The bolts 4 may be placed in the compartments 35*a*, 35*b* by being inserted into the openings 37*a*, 37*b* which are formed between the extending elements 33*a*, 33*b* in the top of the holding structure 9*a*.

The bolts 4 are most often pre-mounted with a plate on one side of the bolt adapted to meet the rock when the bolt 4 is bolted into the rock. These plates may make it hard to stack the bolts 4 in a space-saving and symmetrical manner. In order for the bolts 4 not to rest directly on top of each other in a space-demanding manner hooks or stops (not shown) may be arranged along the height of the compartments 35*a*, 35*b* such that each bolt 4 rests on a hook in the respective compartment 35*a*, 35*b*. The first bolt in each compartment 35*a*, 35 may however rest on the lower base 31*a*, 31*b* of the holder 29*a*, 29*b*, i.e. at the very bottom of the specific compartment 35*a*, 35*b*. The hooks may be pivotally arranged to be able to be rotated from a direction parallel to the bottom of the compartments 35*a*, 35*b* to a direction perpendicular to the bottom of the compartments 35*a*, 35*b*, i.e. so that the hook abuts one of the walls of the apartments 35*a*, 35*b*. When the hooks are arranged parallel to the bottom of the respective compartment 35*a*, 35*b* the bolts which are placed in the compartments 35*a*, 35*b* will thus rest on a respective hook. Bolts resting in the compartments 35*a*, 35*b* may easily be picked out of the magazine 9, since the hook above the bolt which is being picked will be displaced to its position which is perpendicular to the bottom of the compartment 35*a*, 35*b* since the bolt 4 hits the hook from underneath during the picking procedure. When filling the magazine 9 with new bolts 4 the hooks must thus be folded down as each layer is filled such that the next layer may be filled.

The placement of the hooks along the compartments 35*a*, 35*b* will thus determine a resting position for the respective bolt. Seen in the direction of the short sides of the magazine 9 each bolt layer will thus exhibit a bolt position structure. In the example which is illustrate in FIG. 7 the middle two bolts 4 will e.g. rest somewhat higher up than the two outermost bolts 4 in each layer. By arranging this bolt position structure such that it corresponds substantially to the bolt position structure in the feeding magazine 3 the transfer of bolts 4 is facilitated. If the picking device 11 in addition is able to grip or secure the bolts 4 in a way which correspond to the bolt position structure in the magazines 3, 9 a further facilitation of the transfer is achieved. The picking unit 15 is therefore according to one example arranged to grip bolts 4 in pre-determined positions, which positions together exhibit a bolt position structure in the picking unit 15 which substantially correspond to the bolt position structure in the respective magazine 3, 9.

Figure 6:
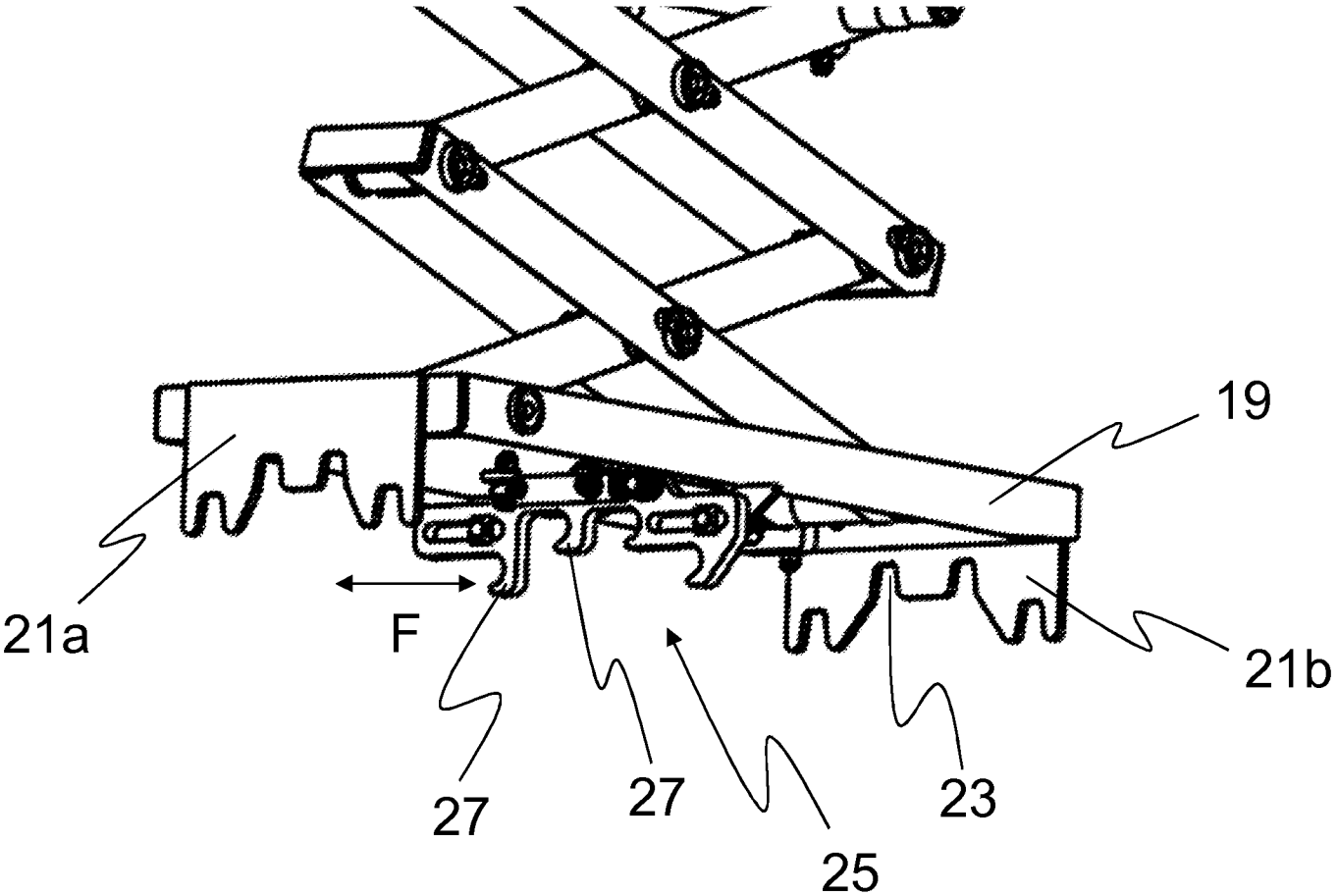
FIG. 6 shows the picking unit in a perspective view.

According to the example which is illustrated in FIGS. 5 and 6 the recesses 23 of the disc-shaped elements 21*a*, 31*b* may be arranged such that they together exhibit a bolt position structure which substantially correspond to the bolt position structure of the respective magazine 3, 9. This may e.g. be achieved by arranging the recesses 23 in the disc-shaped elements 21*a*, 21*b* with different depths, such that bolts will be gripped on different heights or levels in the picking unit 15. The gripping unit 25 must then be arranged such that the bolts are secured in the recesses 23 in the right position. This may e.g. be achieved by the gripping elements 27 being arranged on different positions in the gripping unit 25 such that the position of the gripping elements 27 in the gripping unit 25 corresponds to the recesses 23 of the disc-shaped elements 21*a*, 21*b*. This is e.g. illustrated in FIG. 6.

The picking unit 15 may according to another example be arranged with a flexible or variable bolt position structure. It may thus be arranged to be able to adapt its bolt position structure, e.g. in accordance with the bolt position structure of the magazines 3, 9.

Even if the bolt position structure has been described herein in conjunction with a special example of magazine 3, 9 and picking device 11 it is readily understood that a number of alternatives are possible. The holding structures 3*a*, 9*a* in the magazines 3, 9 may e.g. be arranged with bolt position structures in linear shapes, matrix shapes, round shapes, different kind of patterns etc.

Figure 8:
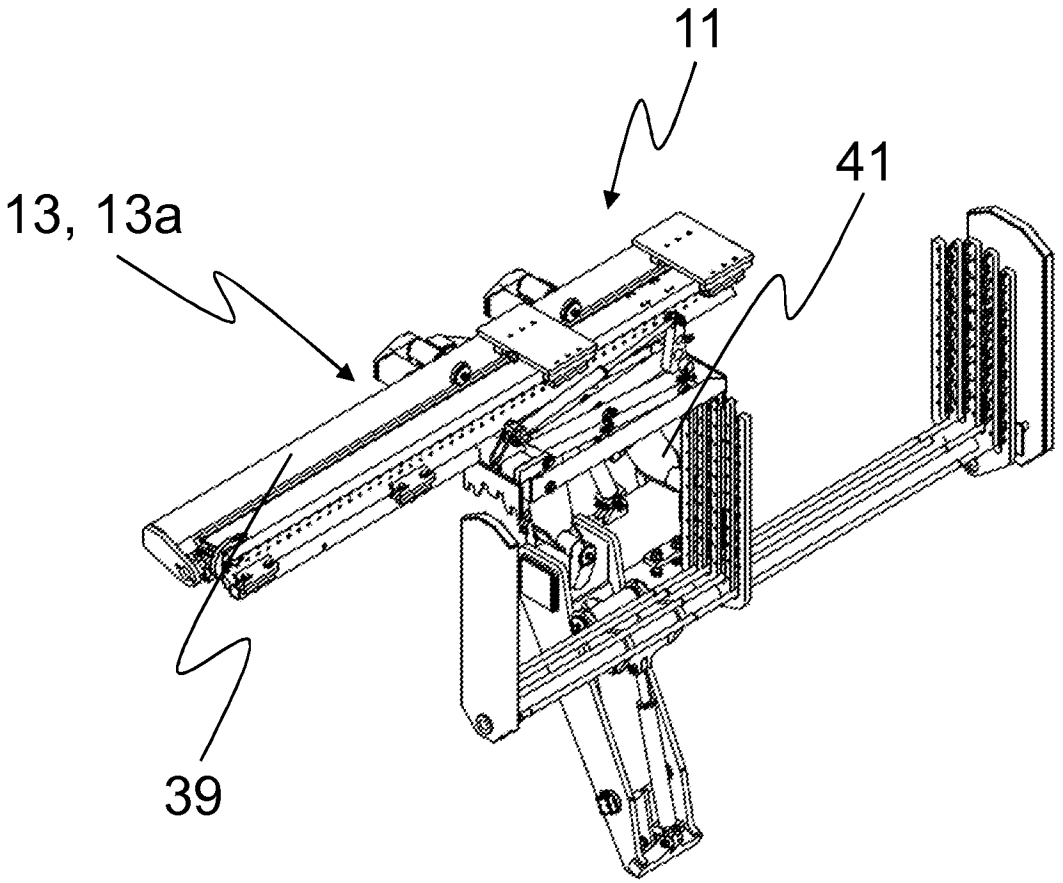
FIG. 8 shows the picking device in a resting position above the loading magazine in a perspective view.
Figure 9:
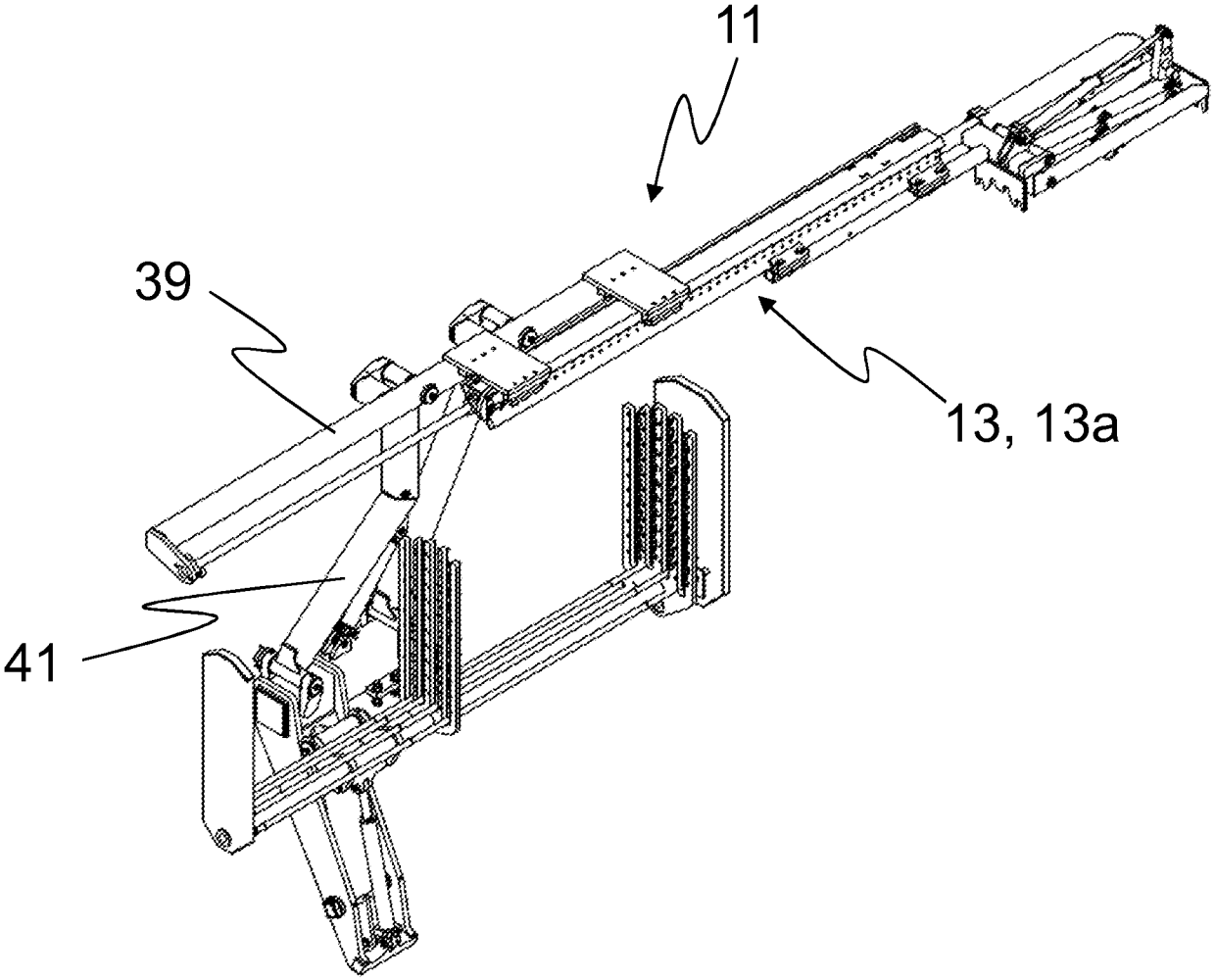
FIG. 9 shows the picking device in a working position as well as the loading magazine.

According to one example which is illustrated in FIGS. 8 and 9, the picking device 11 may be displaced between a working position (for moving bolts 4 in the loading magazine 9) and a resting position (when transfer of bolts 4 in the loading magazine 9 is not needed). In FIG. 8 the picking device 11 is placed in the resting position and in FIG. 9 the picking device 11 is placed in the working position and displaced to a position above the feeding magazine 3 (not shown in the figure). The picking device 11 may e.g. occupy the resting position when the Rig is to be moved or when the bolting procedure is about to start, i.e. at times when bolts in the loading magazine 9 do not need to be moved. The resting position may e.g. be a position where there is less risk that the picking device 11 collides with other moveable parts of the rig 1, e.g. the boom 7. The resting position may also be chosen such that the view of the operator is enhanced when the picking device 11 is located in the resting position, which is advantageous both when performing bolting and when the rig 1 is to be moved. The picking device 11 may e.g. be located further back or further down when in the resting position compared to when in the loading position. The picking device 11 may e.g. be arranged on a positioning arm 39 for displacement between the resting position and the working position. In the example which is shown the picking device 11 is arranged to the positioning arm 39 via the sliding beam 13*a* which has been described above. The positioning arm 39 may in turn be arranged to the rig 1 through a parallel linkage 41 for easy displacement forwards and backwards along the direction of the rig 1. Thereby the picking device 11 may be moved between the two positions.

Figure 10:
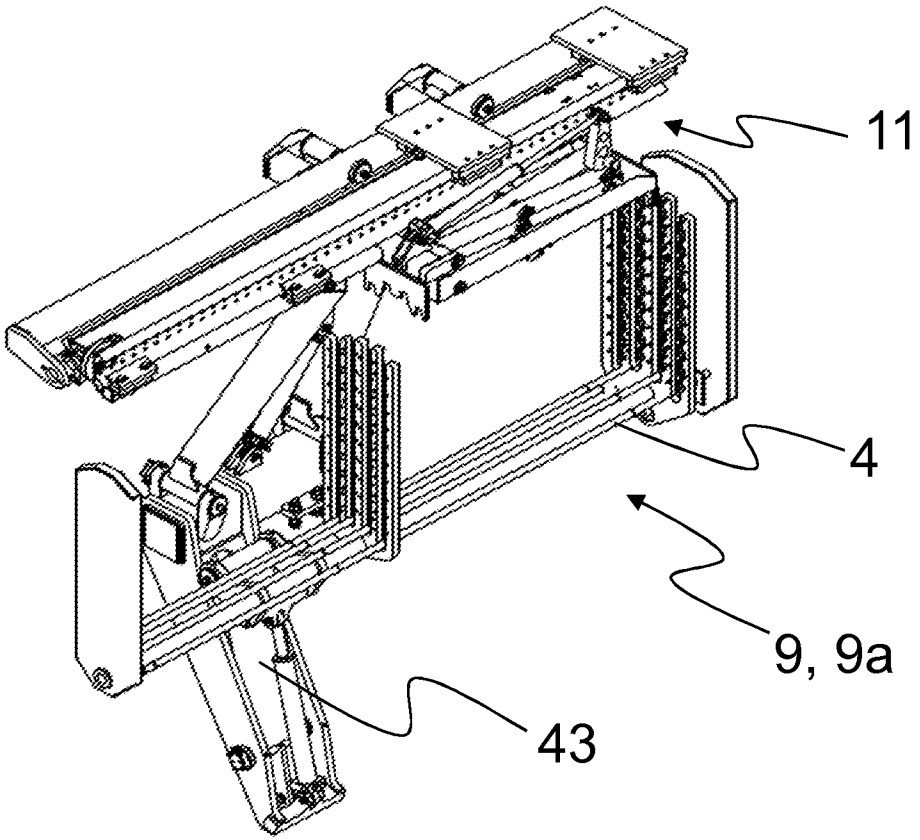
FIG. 10 shows the picking device as well as the loading magazine in a loading position.
Figure 11:
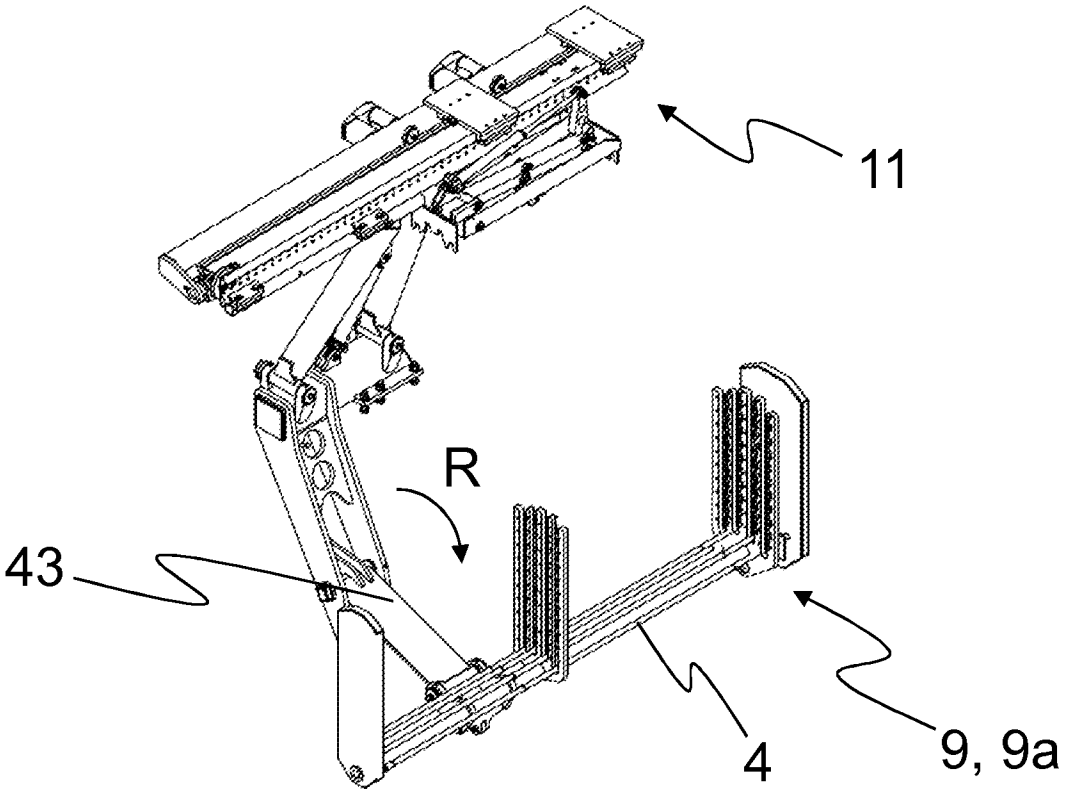
FIG. 11 shows the picking device as well as the loading magazine in a reloading position.
Figure 12:
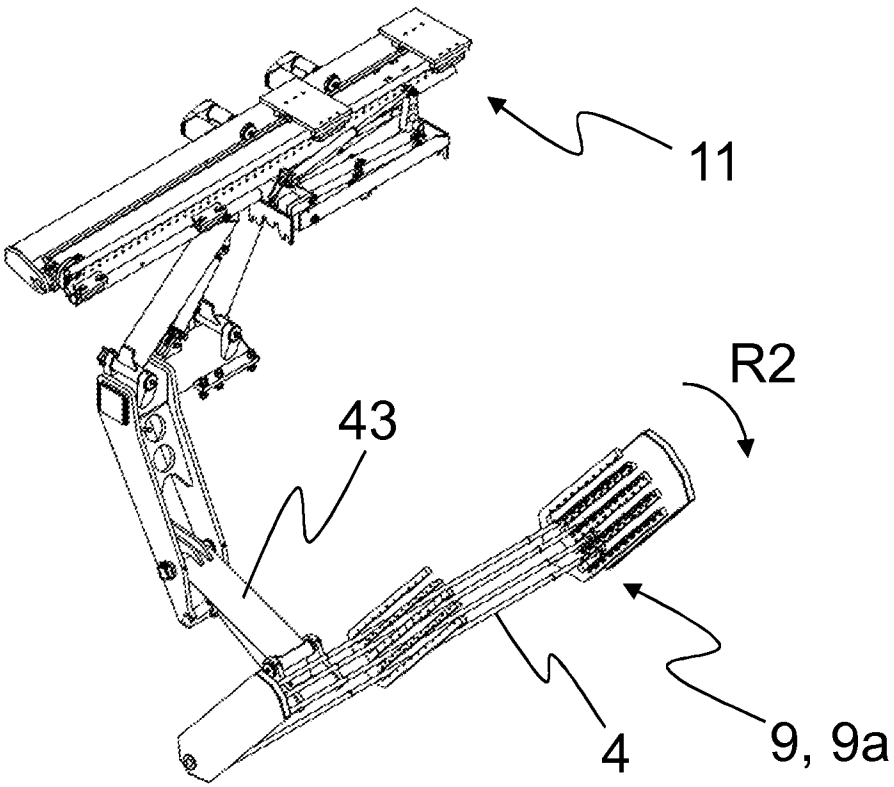
FIG. 12 shows the picking device as well as the loading magazine in a reloading position.

As is illustrated in FIGS. 10 and 11 the loading magazine 9 may according to one example be moved between a loading position and a reloading position. The loading position is shown in FIG. 10 and the reloading position is shown in FIG. 11. When the loading magazine 9 is located in the loading position, which is illustrated in FIG. 10, the picking device 11 may move bolts 4 that are located in the loading magazine 9. The reloading position, which is illustrated in FIG. 11, is adapted for reloading new bolts 4 to the loading magazine 9. The loading magazine 9 may therefore in the reloading position be located closer to the ground than when it is located in the loading position. The loading magazine 9 may e.g. be arranged on an arm 43 which is rotatable arranged on the rig 1. By rotating R or pivoting R the arm 43 as is exemplified in FIG. 11 the magazine 9 may be lowered to the reloading position. The loading magazine 9 may be arranged to the arm 43 in such a way that it stays upright in relation to the support or ground during the entire pivoting R of the arm 43. The movement may e.g. be achieved by a cylinder arranged under the arm 43 and arranged as a parallel linkage. In order to even easier be able to load new bolts 4 the loading magazine 9 may be arranged to, after pivoting the arm 43 down to the reloading position, be arranged to be able to angled down towards the ground or support through a rotation R2 or pivoting R2. This is illustrated in FIG. 12. The angling down may e.g. be achieved by arranging the fastening of the loading magazine 9 in a double jointed manner and the loading magazine 9 may be pivoted using e.g. a cylinder placed under the arm 43.

Even though the picking device 11 hitherto has been described as a tool for picking bolts 4 from the loading magazine 9 to the feeding magazine 3, other solutions for moving bolts in the loading magazine 9 are contemplated. The picking device 11 may for example be arranged to place a holding structure 9*a* from the loading magazine 9 such that the rock reinforcement unit 5 may be feed with bolts 4 directly from the holding structure 9*a*. The picking device 11 may thus be arranged to move a holding structure 9*a* containing at least one bolt 4 from the loading magazine 9 to the feeding magazine 3. When the holding structure 9*a* is composed of the loading magazine 9 the picking device 11 according to this example thus moves the entire loading magazine 9 to a position from which the rock reinforcement unit 5 may be provided with bolts 4 directly out of the loading magazine 9. The feeding device 8 may then for example provide the rock reinforcement unit 5 with bolts 4 from the loading magazine 9 after the picking device 11 have moved the loading magazine 9 to a position in which the bolts 4 in the loading magazine 9 are accessible to the feeding device 8. As an example the feeding magazine 3 may comprise gripping or fastening means for several holding structures 3*a*, 9*a* wherein one holding structure 9*a* in the loading magazine 9 may be moved to the feeding magazine 3 and be arranged to the rig 1 via the fastening means in the feeding magazine 3. The holding structures 3*a*, 9*a* may according to one example be arranged to be able to be moved by a a picking device 11. The holding structures may e.g. be adapted to be able to be lifted by comprising gripping tracks, cavities, extending element having loops or recesses etc. in order to in a smooth way be able to be gripped and moved.

An advantage with the loading magazine 9 or the holding structure 9*a* in the loading magazine 9 not being accessible to the feeding device 8 before it is moved by the picking device 11 is that it does not risk being in the way when the feeding device 8 is supplying the rock reinforcement unit 5 with bolts 4.

According to one example the holding structure 3*a* in the feeding device 3 is arranged to be able to be removed from the feeding device 3. According to one example the picking device 11 is arranged to remove the holding structure 3*a* of the feeding magazine 3 from the feeding magazine 3, for example when it has been emptied from bolts 4. The picking device 11 may in addition be arranged to thereafter place a holding structure 9*a* from the loading magazine 9 in the former place of the holding structure 3*a* in the feeding magazine 3. The exhausted or emptied holding structure 3*a* may e.g. be placed beside the rig 1 or at a position on the rig 1 intended for exhausted or emptied holding structures 3*a*, 9*a*.

The rig 1 or feeding magazine 3 may alternatively be arranged to move the feeding magazine's 3 holding structure 3*a* from its place, e.g. by the holding structure 3*a* being dropped from the rig 1 and/or the feeding magazine 3. The holding structure 3*a* may according to one example be arranged to the rig 1 through a holding mechanism which may release its grip of the holding structure 3*a*. If the feeding magazine 3 is arranged on a boom 7, the boom 7 may e.g. be moved to a position and/or angling adapted to release the holding structure 3*a*, where-after the holding mechanism releases its grip of the holding structure 3*a* and it falls to the ground. The picking device 11 may be arranged to thereafter place a holding structure 9*a* from the loading magazine 9 on the former place of the feeding magazine's 3 holding structure 3*a*.

In order to facilitate the operation in the examples above, holding structures 9*a* of the loading magazine 9 and holding structures 3*a* of the feeding magazine 3 may be arranged substantially identical. Thereby the act of replacing the holding structures 3*a*, 9*a* is facilitated. When the holding structure 9*a* from the loading magazine 9 has taken the holding structure's 3*a* place in the feeding magazine 3 it will function precisely as the previous holding structure 3*a*, i.e. the feeding device 8 may provide the rock reinforcement unit 5 with bolts 4. If the rig 1 comprises several holding structures 9*a* in the loading magazine 9, the procedure of replacing holding structures 3*a*, 9*a* may be repeated several times.

A method at a rig for moving bolts will now be described in conjunction with FIG. 13. The method steps that are optional are marked with dashed lines in the figures.

The method steps that are described below may e.g. be performed by a control unit.

Figure 13:
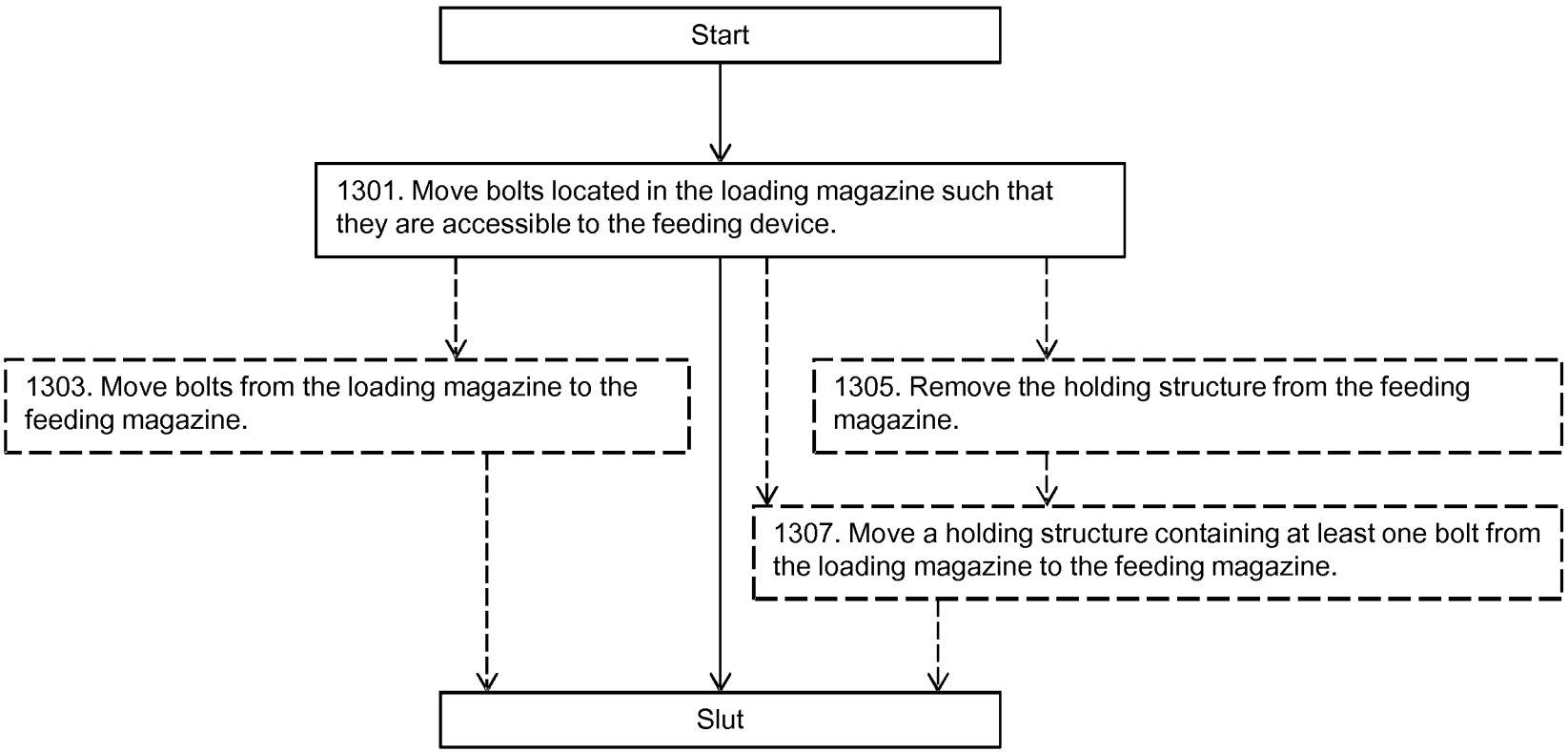
FIG. 13 shows a flow chart illustrating a method at a rig for moving bolts.

FIG. 13 illustrates an exemplifying method for moving bolts 4 at a rig 1 adapted for rock reinforcement. The rig 1 comprises a feeding magazine 3 comprising a holding structure 3*a* for bolts, wherein the feeding magazine 3 is arranged in conjunction to a rock reinforcement unit 5. The rig 1 further comprises a feeding device 8 that is arranged to provide the rock reinforcement unit 5 with bolts from the feeding magazine 3. The rig 1 furthermore comprises a loading magazine 9 comprising a holding structure 9*a* for bolts as well as a, relative to the feeding magazine 3 and the loading magazine 9, movable picking device 11. The method comprises: to with the picking device move 1301 bolts 4 located in the loading magazine such that they are accessible to the feeding device 8.

By following the above described method, bolts 4 that are located in the loading magazine 9 may be moved such that they can be used by the rock reinforcement unit 5 for bolting.

The method may further comprise: to with the picking device 11 move 1303 bolts from the loading magazine 9 to the feeding magazine 3.

According to one example the picking device 11 comprises a transportation unit 13 and a picking unit 15 as has been described above. An example of how bolts 4 may be moved between the loading magazine 9 and the feeding magazine 3 in that case will now be described in conjunction with FIG. 14-17. In the described case the holding structure 3*a* of the feeding magazine 3 is composed of the feeding magazine 3 and the holding structure 9*a* of the loading magazine 9 is composed of the loading magazine 9. These will therefore be referred to only as the feeding magazine 3 and the loading magazine 9

In the described case the feeding magazine 3 is arranged on a boom 7 together with a rock reinforcement unit 5. The boom 7 is movable in order to be able to align the rock reinforcement unit 5 with different positions in the rock.

Figure 14:
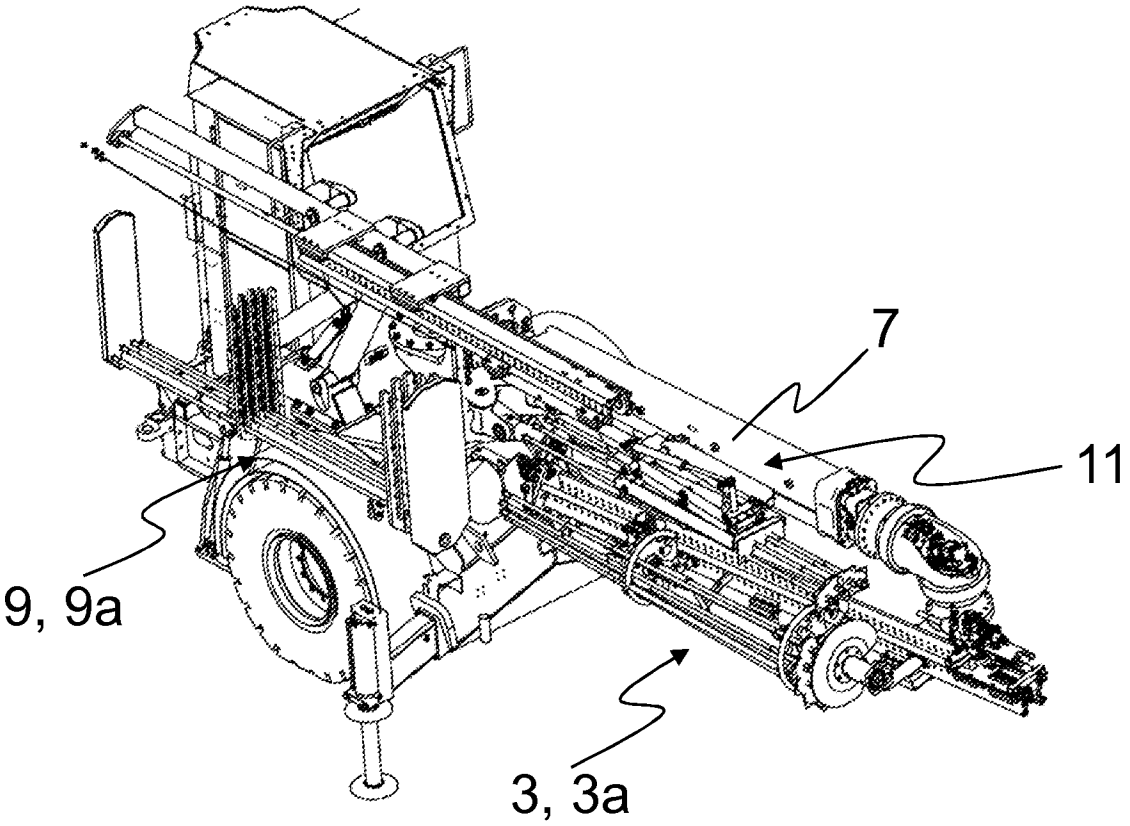
FIG. 14 shows an example of bolts being moved between magazines on the rig, FIG. 15 also show an example of bolts being moved between magazines on the rig, FIG. 16 also show an example of bolts being moved between magazines on the rig, and FIG. 17 also show an example of bolts being moved between magazines on the rig.
Figure 15:
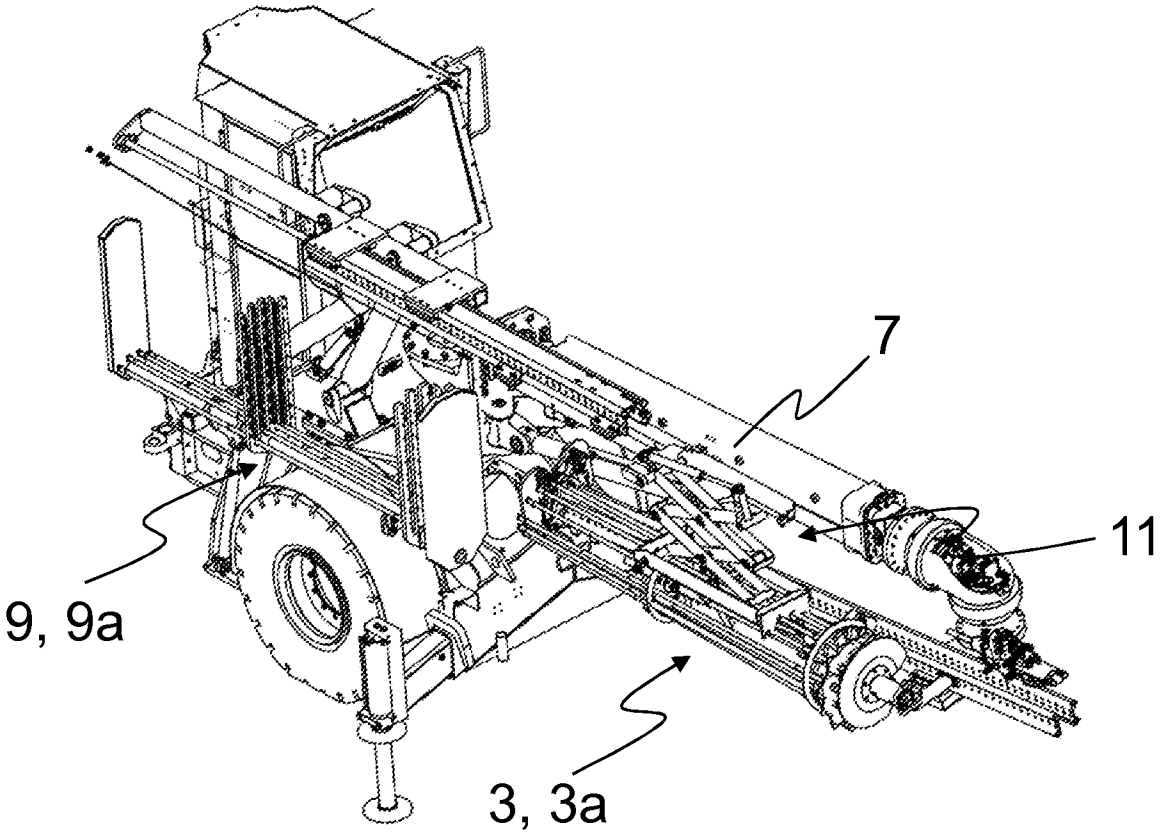
Figure 16:
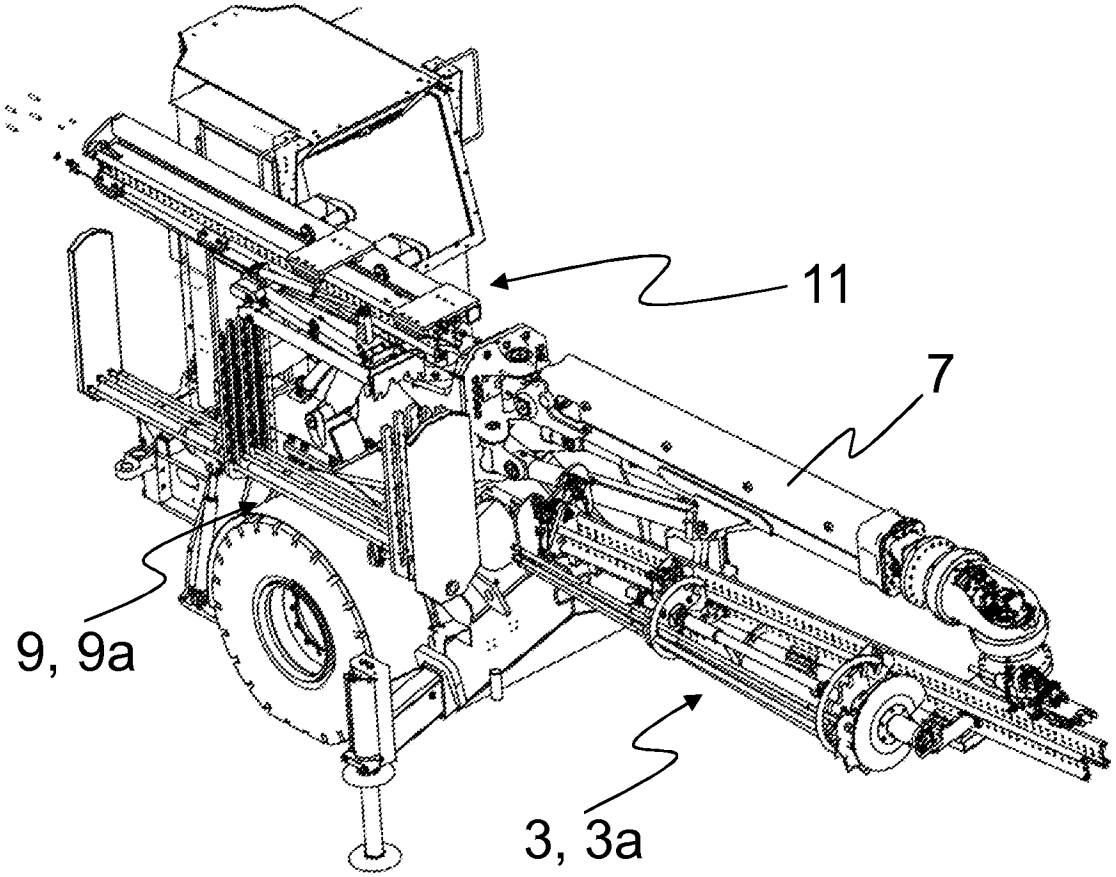
Figure 17:
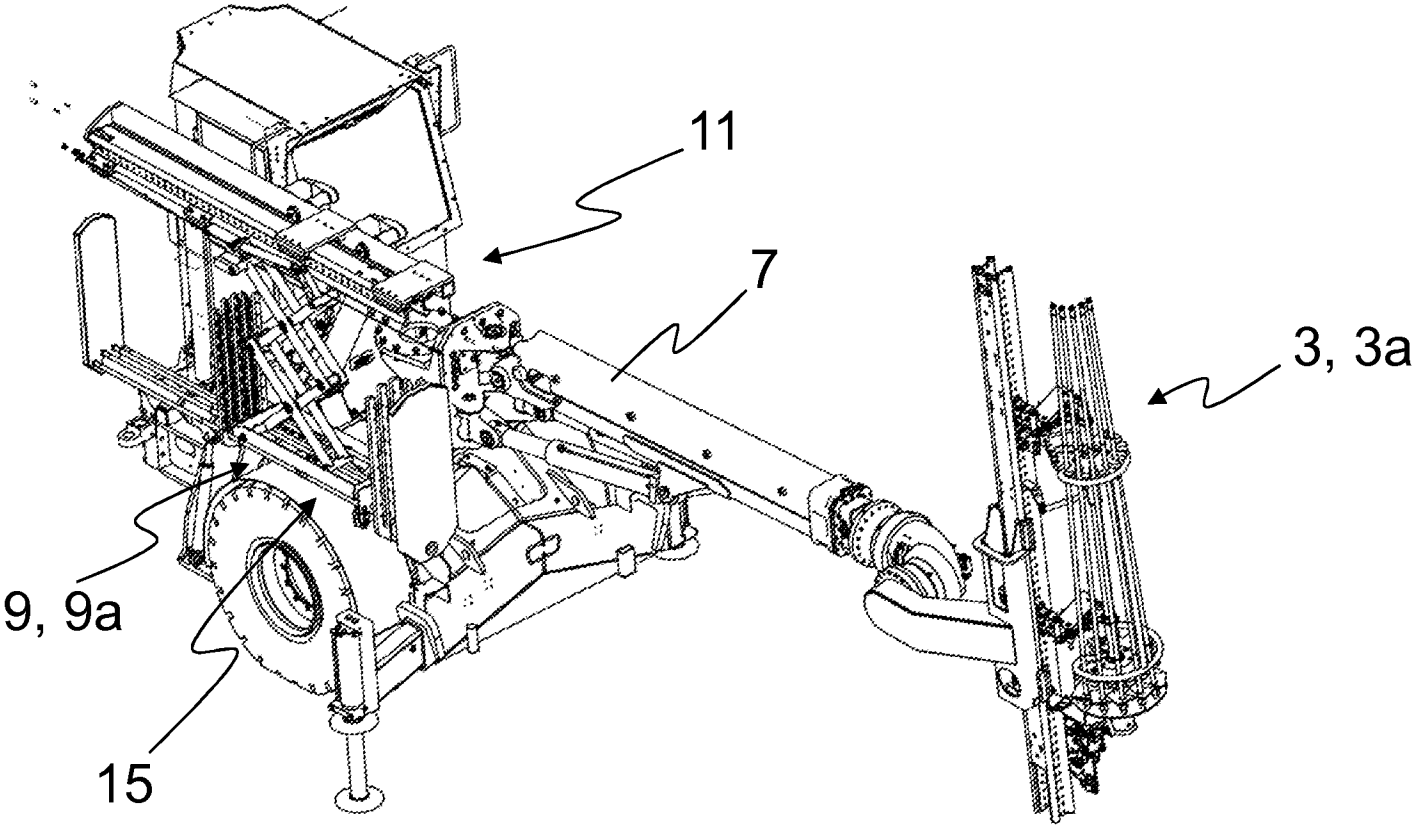

In this example the boom 7 is directed such that the loading magazine 9 and the feeding magazine 3 are aligned. If the boom 7 comprises a revolving magazine 3 and a drill tip, the drill tip may e.g. be aligned to the front part of the loading magazine 9 seen in the direction of elongation of the rig 1. The magazines 3, 9 will then be aligned. In the example that is shown in FIG. 14 the magazines 3, 9 are aligned and the picking device 11 is moved to a position above the feeding magazine 3. In FIG. 14 the picking device 11 has already collected four bolts 4 from the loading magazine 9.

In order to collect bolts 4, the picking device 11 may be positioned in a position above the loading magazine 9. This may e.g. be achieved by the transportation unit 13 moving to a position above the loading magazine 9. This position may be seen in FIG. 16. If the picking device is located on a telescopic sliding beam 13*a*, then the telescopic sliding beam 13*a* may assume a minimally extended position. It should be noted that during movement of the transportation unit 13 the picking unit 15 is located in the transportation position, i.e. as close as possible to the transportation unit 13.

The picking unit 15 may thereafter be moved relative to the transportation unit 13 down into a picking position in the loading magazine 9. This may e.g. be achieved by a scissor lift 17, on which the picking unit 15 is arranged, extending. The movement of the picking unit 15 may e.g. be performed until the picking unit 15 hits bolts in the loading magazine 9. The picking unit 15 may alternatively be moved down to the bolts 4 based on data from a sensor which senses the position of the picking unit 15. The picking unit 15 thereafter grips one or more bolts. A gripping unit 25 may e.g. secure bolts in the picking unit 15. In the example illustrated in FIG. 17 the picking unit 15 is located in the picking position down in the loading magazine 9.

Thereafter the picking unit 15 is moved up to the transportation position again, e.g. by the scissor lift 17 being folded together. When the picking unit 15 is located in the transportation position the transportation unit 13 and thereby the picking unit 15 is moved to the feeding magazine 3. This may e.g. be achieved by the telescopic sliding beam 13*a* extending to an outer position where the transportation unit 13 is located above the feeding magazine 3. The picking unit 15 is thereafter moved down to the feeding magazine 3 and releases the bolts in the feeding magazine 3, which is illustrated in conjunction with FIG. 15. The boom 7 may alternatively be raised up to the picking device 11 and the picking unit 15 where-after the bolts 4 are released in the feeding magazine 3.

Thereafter the picking unit 15 may be moved to the transportation position and the procedure may be repeated for collection of more bolts 4. If the feeding magazine 3 comprises a holding arm for securing that bolts do not fall out, it must be moved to the side when placing new bolts 4 in the feeding magazine 3. It may thereafter secure the bolts 4 before the picking device 11 is moved out of the feeding magazine 3.

The order of the measures that have been described above may be moved around. Some steps may also be performed simultaneously. The picking device 11 may e.g. collect bolts 4 from the loading magazine 9 before the feeding magazine 3 is aligned with the loading magazine 9, or while the feeding magazine 3 is aligned with the loading magazine 9. The picking device 11 will then be ready to immediately transfer bolt 4 when the magazines 3, 9 have been positioned for transfer.

The method according to FIG. 14 may alternatively comprise: that with the picking device 11 move 1307 a holding structure 9*a* containing at least one bolt 4 from the loading magazine 9 to the feeding magazine 3.

The method may in a preparatory step further comprise: to remove 1305 the holding structure 3*a* from the feeding magazine 3.

The original holding structure 3*a* of the feeding magazine 3 may then be placed, lifted or dropped to the side, either on the rig 1 or beside the rig 1, before a holding structure 9*a* from the loading magazine 9 is placed in its position. Alternatively the holding structure 9*a* of the loading magazine 9 is only moved to a position in the feeding magazine 3 which is in close proximity of the rock reinforcement unit 5, so that bolts may thereafter be moved directly from the holding structure 9*a* of the loading magazine 9 to the rock reinforcement unit 5.

The step of removing 1305 the holding structure 3*a* from the feeding magazine 3 may according to one example be performed by the picking device 11. The picking device 11 then lifts the holding structure 3*a* of the feeding magazine 3 from its position before it places the holding structure 9*a* of the loading magazine 9 on the feeding magazine's 3 holding structure's 3*a* former position, or another suitable position in the feeding magazine 3. According to another example the step of removing 1305 the feeding magazine's 3 holding structure 3*a* from its position amounts to releasing the holding structure 3*a* from its position. This may e.g. be achieved by the holding structure 3*a* being arranged to the rig 1 through a holding mechanism which can let go of its grip of the holding structure 3*a*. If the feeding magazine 3 is arranged on a boom 7, the boom 7 may e.g. be moved to a position and/or angling adapted to release the holding structure 3*a*, where-after the holding mechanism releases its grip of the holding structure 3*a* and it falls to the ground.

Even though the invention has been described in conjunction with a number of examples above, the description is only meant to illustrate inventive concepts and does not limit the scope of the invention. Terms such as "bolt position structure" and "holding structure" has for example been used throughout the description, but corresponding entities, function and/or parameters could also have been used that have the features and/or characteristics that has been described in conjunction to the terms herein. The invention is defined by the attached patent claims.

The invention claimed is:

1. A unitary rig device adapted for rock bolting comprising:

a feeding magazine, wherein the feeding magazine comprises a holding structure for bolts and is arranged in conjunction with a rock reinforcement unit;

a feeding device that is arranged to provide the rock reinforcement unit with bolts from the feeding magazine, the unitary rig device further comprises:

a loading magazine comprising a holding structure for bolts;

a movable picking device that is moveable relative to the feeding magazine and the loading magazine, the movable picking device configured to move bolts located in the loading magazine such that the bolts are accessible to the feeding device.

2. The unitary rig device according to claim 1, wherein the picking device is arranged to move bolts from the loading magazine to the feeding magazine.

3. The unitary rig device according to claim 2, wherein the picking device comprises a transportation unit arranged to be moved between the loading magazine and the feeding magazine as well as a picking unit moveably arranged to the transportation unit and arranged to be moved relative to the transportation unit between a transportation position outside the magazines and a picking position inside the respective magazine, wherein the picking unit is further arranged to pick up or drop off a bolt when the picking unit is located in the picking position.

4. The unitary rig device according to claim 3, wherein the picking unit is arranged to grip bolts in predetermined positions, wherein these positions together exhibit a bolt position structure in the picking unit, wherein the bolt position of the picking unit substantially correspond to the boll position structure or the respective magazines.

5. The unitary rig device according to claim 3, wherein the transportation unit is arranged to be moved between the loading magazine and the feeding magazine through a first linear movement between the magazines, and wherein the picking unit is arranged to be moved between the transportation position and the picking position through a second linear movement directed at an angle relative the first linear movement.

6. The unitary rig device according to claim 3, wherein the picking unit has an elongated shape and comprises two disc-shaped elements arranged at a distance from each other in the longitudinal extension of the picking unit, wherein the disc-shaped elements comprises several recesses arranged to receive bolts, wherein the picking unit further comprises a gripping unit arranged to secure bolts in said recesses during movement between the loading magazine and the feeding magazine.

7. The unitary rig device according to claim 6, wherein the recesses of the disc-shaped elements are arranged on the disc-shaped elements such that these recesses together exhibit a bolt position structure that substantially correspond to the bolt position structure of the magazines respectively.

8. The unitary rig device according to claim 6, wherein the gripping unit is arranged between the disc-shaped elements and can be moved between an open position and a closed position by a displacement of the gripping unit in a direction directed at an angle to the longitudinal extension of the picking unit, wherein the gripping unit is arranged to secure a bolt which is received in and extends between a recess in the first disc-shaped element and a recess in the second disc-shaped element when the gripping unit is positioned in the closed position.

9. The unitary rig device according to claim 1, wherein the holding structures of the loading magazine and the feeding magazine are arranged to hold bolts in predetermined positions, wherein these positions together exhibit a bolt position structure within the respective magazine.

10. The unitary rig device according to claim 9, wherein the bolt position structure of the loading magazine substantially corresponds to the bolt position structure of the feeding magazine.

11. The unitary rig device according to claim 1, wherein the picking device is arranged to be moved between a working position wherein the picking device can move bolts that are located in the loading magazine as well as a resting position adapted for bolting or moving of the rig device.

12. The unitary rig device according to claim 1, wherein the loading magazine can move between a reloading position for reloading of bolts from an external source, and a loading position for said movement of bolts that are located in the loading magazine.

13. The unitary rig device according to claim 1, wherein the picking device is arranged to move a holding structure containing at least one bolt from the loading magazine to the feeding magazine.

14. The unitary rig device according to claim 1, wherein the holding structure in the feeding magazine is arranged to be able to be removed from the feeding magazine.

15. The unitary rig device according to claim 14, wherein the picking device is further arranged to remove the holding structure of the feeding magazine from the feeding magazine.

16. A method performed by a unitary rig device for moving bolts, wherein the unitary rig device is adapted for rock bolting, wherein the device comprises:

a feeding magazine, wherein the feeding magazine comprises a holding structure for bolts, wherein the feeding magazine is arranged in conjunction with a rock reinforcement unit;

a feeding device that is arranged to provide the rock reinforcement unit with bolts from the feeding magazine;

a loading magazine comprising a holding structure for bolts;

a movable picking device that is moveable relative to the feeding magazine and the loading magazine, wherein the method comprises:

moving bolts that are located in the loading magazine with the picking device such that the bolts are accessible to the feeding device.

17. The method according to claim 16, wherein the method further comprises:

moving a holding structure to the feeding magazine with the picking device, wherein the holding structure contains at least one bolt from the loading magazine.

18. The method according to claim 16, wherein the holding structure in the feeding magazine is arranged to be able be removed from the feeding magazine, wherein the method further comprises:

removing the holding structure from the feeding magazine.

19. The method according to claim 18, wherein the method further comprises:

removing the holding structure from its position using the picking device.

20. The method according to claim 16, wherein the method further comprises:

moving bolts from the loading magazine to the feeding magazine with the picking device.

* * * * *